US007837536B2

(12) United States Patent
Haneda et al.

(10) Patent No.: US 7,837,536 B2
(45) Date of Patent: Nov. 23, 2010

(54) POLISHING APPARATUS, POLISHING BRUSH AND MANUFACTURING METHOD OF DISK-SHAPED SUBSTRATE

(75) Inventors: Kazuyuki Haneda, Ichihara (JP); Yosuke Sato, Minamitsuru-gun (JP)

(73) Assignees: Showa Denko K.K., Tokyo (JP); Citizen Seimitsu Co., Ltd., Yamanashi (JP)

( * ) Notice: Subject to any disclaimer, the term of this patent is extended or adjusted under 35 U.S.C. 154(b) by 208 days.

(21) Appl. No.: 11/944,004

(22) Filed: Nov. 21, 2007

(65) Prior Publication Data

US 2008/0119115 A1 May 22, 2008

(30) Foreign Application Priority Data

Nov. 22, 2006 (JP) ..... 2006-316342
Dec. 6, 2006 (JP) ..... 2006-329255

(51) Int. Cl.
*B24B 1/00* (2006.01)

(52) U.S. Cl. ..... 451/41; 451/150; 451/469

(58) Field of Classification Search ..... 451/41, 451/463–469, 51, 150
See application file for complete search history.

(56) References Cited

U.S. PATENT DOCUMENTS 658,416 A * 9/1900 Yale ..... 15/198
2,358,464 A * 9/1944 Mayer ..... 15/190
2,363,217 A * 11/1944 Woodling ..... 300/21
4,276,674 A * 7/1981 Hunt ..... 15/182
4,646,479 A * 3/1987 Walker et al. ..... 451/59
4,756,044 A * 7/1988 Clark ..... 15/182
4,882,879 A * 11/1989 Warner et al. ..... 451/469
5,045,091 A * 9/1991 Abrahamson et al. ..... 51/293
5,358,311 A * 10/1994 Drumm ..... 300/21
5,406,669 A * 4/1995 Lesiw ..... 15/179
6,615,613 B1 9/2003 Iwabuchi et al.
2008/0176489 A1 * 7/2008 Haneda et al. ..... 451/44

FOREIGN PATENT DOCUMENTS

JP 58-140050 U 9/1983
JP 60-052265 A 3/1985
JP 11-33886 A 2/1999
JP 11-221742 A 8/1999
JP 2000185927 A * 7/2000
JP 2001-162510 A 6/2001
JP 2004-155652 A 6/2004
JP 2004-174191 A 6/2004
JP 2004342307 A * 12/2004
JP 2005220018 A * 8/2005
JP 2005-288073 A 10/2005
JP 2006-015450 A 1/2006
JP 2006-102040 A 4/2006

* cited by examiner

*Primary Examiner*—Maurina Rachuba
(74) *Attorney, Agent, or Firm*—Sughrue Mion, PLLC

(57) ABSTRACT

The polishing apparatus that polishes an inner circumferential surface of a disk-shaped substrate including a portion having a hole at the center thereof, the polishing apparatus is provided with: a rotating table that holds piled workpieces in which a plurality of disk-shaped substrates are piled, a polishing brush that is inserted into a portion having the hole of the disk-shaped substrates of the piled workpieces and is rotated, a cover member that covers the piled workpieces, and a polishing-liquid flowing-in unit that flows polishing liquid into the portion having the hole of the disk-shaped substrates of the piled workpieces covered by the cover member.

14 Claims, 18 Drawing Sheets

FIRST LAPPING PROCESS

INNER AND OUTER CIRCUMFERENCE GRINDING PROCESS

OUTER CIRCUMFERENCE POLISHING PROCESS

SECOND LAPPING PROCESS

INNER CIRCUMFERENCE POLISHING PROCESS

FIRST POLISHING PROCESS

SECOND POLISHING PROCESS

FINAL WASHING AND INSPECTION PROCESS

FIG.11A CONFIGURATION OF PRESENT EMBODIMENT
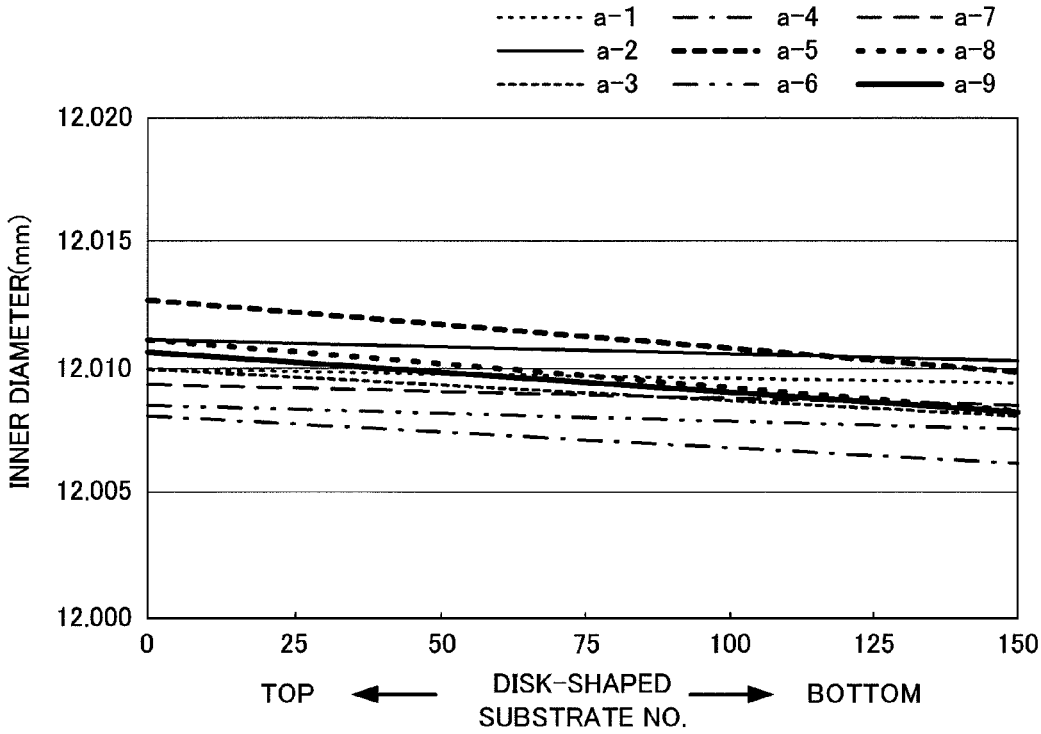
FIG.11B COMPARATIVE EXAMPLE
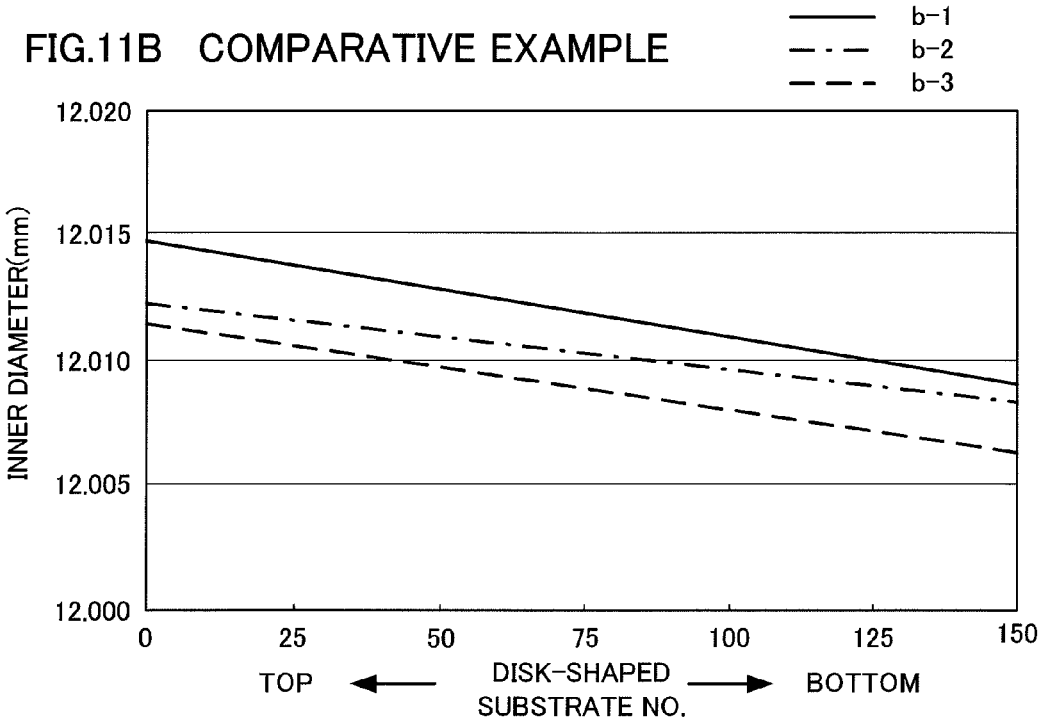

RELATED ART

POLISHING APPARATUS, POLISHING BRUSH AND MANUFACTURING METHOD OF DISK-SHAPED SUBSTRATE

CROSS REFERENCE TO RELATED APPLICATIONS

This application is based on and claims priority under 35 USC §119 from Japanese Patent Applications No. 2006-316342 filed Nov. 22, 2006 and No. 2006-329255 filed Dec., 6, 2006.

BACKGROUND OF THE INVENTION

1. Field of the Invention

The present invention relates to a polishing apparatus that polishes an inner circumferential surface of a disk-shaped substrate inner circumference, for example, a glass substrate for a magnetic recording medium or the like, a polishing brush and a manufacturing method of the disk-shaped substrate.

2. Description of the Related Art

In recent years, the production of disk substrates as disk-shaped substrates has been activated, under increased demands as recording media. As a magnetic disk substrate as one of the disk substrates, an aluminum substrate and a glass substrate are used widely. The aluminum substrate is characterized by its high processability and low cost, meanwhile the glass substrate is characterized by its excellent strength, surface smoothness, and flatness. In particular, requirements for compact size and high density of disk substrates recently have become extremely high, and the glass substrate of which surface roughness is small and that enables high density has attracted a lot of attention.

As the related art with regard to such a manufacturing equipment that manufactures a magnetic disk substrate described in official gazettes, there is an art of polishing the inner circumferential surface of a glass disk including a portion having a hole at the center (for example, refer to patent documents 1 and 2).

In the patent document 1, piled glass disks are set rotatably around the central axis, and a shaft mounted polishing brush having numerous brush bristles around its axis is inserted into the portions having a hole at the center of the piled glass disks. Thereafter, this shaft mounted polishing brush is reciprocated, while the shaft is rotated in the reverse direction to the rotation direction of the piled glass disk, and thereby the inner circumferential surfaces of the piled glass disks are polished.

Further, in the patent document 2, a polishing method is proposed where glass substrates are soaked in polishing liquid including separate abrasive, and thereby insufficient polishing and polishing failure due to liquid shortage are prevented. Furthermore, in the patent document 2, an art is disclosed where brush bristles implanted spirally on rotation axis are rotated to polish the surfaces, and fresh polishing liquid is always circulated and supplied to the surfaces to be polished, and thereby polishing efficiency, reproducibility and precision are increased.

FIG. 17 shows an example of a conventional method of polishing an inner circumferential surface of a disk-shaped substrate according to the related art.

In the polishing method shown in FIG. 17, piled workpieces 501 configured by piling a large number of disk-shaped substrates 10 in the center-axis direction are mounted on a rotating table (not shown in the figure), with the axial direction set vertically. Into a portion having a hole at the center 501A of the piled workpieces 501, a polishing brush

502 of which shape is like a shaft connected to a rotating driving shaft that is not shown in the figure at the upper end is inserted and arranged. In addition, on the top of the piled workpieces 501, nozzles 503 that supply polishing liquid including abrasive are arranged.

While the polishing liquid is supplied from the nozzles 503 to the upper face of the piled workpieces 501, the piled workpieces 501 are rotated and the polishing brush 502 is also rotated and reciprocated in the axial direction so that an inner circumferential surface of the portion having the hole at the center 501A of the piled workpieces 501 (that is, the inner circumferential surface of the disk-shaped substrate 10) is polished.

On the polishing brush 502, a brush rows is provided spirally with a predetermined pitch having a predetermined interval (a portion having brush clearance) around a shaft core. By this arrangement, the portion having the brush clearance is also formed spirally with the same pitch as that of the brush rows.

In the polishing method as shown in FIG. 17, the polishing liquid supplied to the upper face of the piled workpieces 501 flows as shown by arrows in FIG. 17 and is supplied to a polishing work area (between the polishing brush 502 and the inner circumferential surface of the piled workpieces 501) during the polishing work. That is, the polishing liquid flows into the portion having the hole at the center 501A of the piled workpieces 501, passes through the portion having the brush clearance of the polishing brush 502 and reaches the polishing work surface. Then, the polishing liquid is moved downward by the spiral action of the portion having the brush clearance caused by rotation of the polishing brush 502 and finally drained downward from the lower end of the portion having the hole at the center 501A of the piled workpieces 501.

[Patent Document 1]

Japanese Unexamined Patent Application Publication No. 11-33886.

[Patent document 2]

Japanese Unexamined Patent Application Publication No. 11-221742.

Here, in the above conventional polishing method of polishing the inner circumferential surface, polishing efficiency is varied depending on rigidity (brush hardness) of the polishing brush as a whole.

That is, by using a polishing brush with higher brush hardness, rapid polishing may be realized. As a result, working efficiency is improved, and productivity is raised, which contributes to cost reduction. On the other hand, if the brush hardness of the polishing brush is too high, polishing is uneven and finishing accuracy is lowered.

Therefore, in order to carry out stably and efficiently polishing work with high precision, a polishing brush with appropriate brush hardness and brush bristle materials collecting at the center thereof needs to be used.

However, the brush hardness of the polishing brush is varied not only by various factors such as materials, wire diameter, length and the like of the brush bristle material but also by bundling form of the brush bristle material. Thus, for example, even if a brush of which brush bristle material, wire diameter and length are controlled is used, there may be a case where stable polishing is not performed.

Further, in the above conventional polishing method of polishing the inner circumferential surface, it is difficult to supply polishing liquid evenly and sufficiently in the vertical direction of the piled workpieces which is a polishing work area, therefore, polishing becomes uneven in the vertical direction of the piled workpieces.

That is, as mentioned above, during the polishing work, the polishing liquid supplied to the upper face of the piled workpieces passes through a narrow portion having the brush clearance from the upper face and reaches the polishing work area and moves gradually downward while polishing. Therefore, the amount of the polishing liquid supplied to the polishing work area is limited, and since the location where the polishing liquid is supplied is limited to the upper face, the amount of the polishing liquid used in the polishing is largely varied depending on the location in the piled workpieces. As a result, the polished state of the inner circumference polishing differs depending on the location in the piled workpieces, and it becomes difficult to perform inner circumference polishing with little unevenness and high precision with respect to individual disk substrates configuring the piled workpieces.

Accordingly, the present invention is made in consideration of the above-mentioned problems. An object of an illustrative, non-limiting embodiment of the present invention is to overcome the disadvantage described above and to provide a polishing apparatus that promotes supply of the polishing liquid to the polishing work area and performs even polishing in the piled direction of the piled workpieces, and the like.

Another object is to provide a polishing brush for carrying out stably and efficiently the polishing work with a high precision.

SUMMARY OF THE INVENTION

According to an aspect of the present invention, there is provided a polishing apparatus that polishes an inner circumferential surface of a disk-shaped substrate including a portion having a hole at the center thereof, the polishing apparatus is provided with: a holding unit that holds piled workpieces in which plural disk-shaped substrates are piled; a polishing brush that is inserted into the portion having the hole of the disk-shaped substrates of the piled workpieces and is rotated; a cover member that covers the piled workpieces; and a polishing-liquid flowing-in unit that flows polishing liquid into the portion having the hole of the disk-shaped substrates of the piled workpieces covered by the cover member.

In one aspect of the polishing apparatus of the present invention, the polishing brush is provided with a shaft core, a brush base wound around the shaft core, and a brush bristle bent and attached in a bundle to the brush base, and the brush bristle is attached to the brush base by being bent so that one end side and the other end side of the bundle are put together.

In another aspect of the polishing apparatus of the present invention, the piled workpieces has a guide spacer between the piled disk-shaped substrates, the guide spacer has a portion having a hole at the center thereof and a penetration portion that penetrates a portion between the portion having the hole and the outside thereof, and the polishing-liquid flowing-in unit flows the polishing liquid into the portion having the hole of the disk-shaped substrate via the penetration portion of the guide spacer.

In further aspect of the polishing apparatus of the present invention, the cover member is formed so that the polishing liquid is led to the guide spacers along an outer circumferential surface of the piled workpieces.

In furthermore aspect of the polishing apparatus of the present invention, the cover member covers the piled workpieces with a portion having a predetermined clearance between the outer circumferential surface of the piled workpieces and the cover member.

In furthermore aspect of the polishing apparatus of the present invention, the cover member is cylindrically formed and has a portion having a drain hole for the polishing liquid in the vicinity of one end of the cover member.

A polishing apparatus that polishes an inner circumferential surface of a disk-shaped substrate including a portion having a hole at the center, the polishing apparatus is provided with: a holding unit that holds piled workpieces in which plural disk-shaped substrates are piled; a polishing brush that is inserted into the portion having the hole of the disk-shaped substrates of the piled workpieces and is rotated; and a polishing-liquid flowing-in unit that flows polishing liquid into the portion having the hole of the disk-shaped substrates of the piled workpieces. The polishing brush is provided with: a shaft core; a brush base wound around the shaft core; and a brush bristle bent and attached to the brush base as a bundle, and the brush bristle is attached to the brush base by being bent so that one end side and the other end side of the bundle are put together.

In one aspect of the polishing apparatus of the present invention, the polishing brush is provided with a core material that restricts bending of the brush bristle inside the bending of the brush bristle, and the brush base attaches the brush bristle while wrapping the core material and the brush bristle.

A polishing brush that is used for polishing of a disk-shaped substrate including a portion having a hole at the center thereof, the polishing brush is provided with: a shaft core; a brush base wound around the shaft core; and a brush bristle bent and attached to the brush base as a bundle. The brush bristle is attached to the brush base by being bent so that one end side and the other end side of the bundle are put together.

In one aspect of the polishing brush of the present invention, the brush base to which the brush bristle is attached is wound spirally around the shaft core, and the one end side and the other end side of the brush bristle extend radially from the shaft core.

In another aspect of the polishing brush of the present invention, the polishing brush is further provided with: a core material that restricts bending of the brush bristle inside the bending of the brush bristle. The brush base attaches the brush bristle while wrapping the core material and the brush bristle.

In further aspect of the polishing brush of the present invention, the brush bristle as the bundle are bent in such a state that the one end side and the other end side of the brush bristle are concentrated toward the center part of the core material from the position restricted by the core material.

A manufacturing method of a disk-shaped substrate by polishing an inner circumferential surface of the disk-shaped substrate including a portion having a hole at the center, the manufacturing method of the disk-shaped substrate includes: a holding process that holds piled workpieces in which plural disk-shaped substrates to be polished are piled; a covering process that covers an outer circumferential surface of the piled workpieces held by a cover member in the holding process; and a polishing process that polishes the inner circumferential surface of the disk-shaped substrate by inserting a polishing brush into the portion having the hole of the disk-shaped substrates in the piled workpieces covered by the cover member and held in the holding process, rotating the polishing brush and flowing polishing liquid into the portion having the hole.

In one aspect of the manufacturing method of the disk-shaped substrate of the present invention, the polishing brush used in the polishing process is provided with: a shaft core; a brush base wound around the shaft core; and a brush bristle bent and attached to the brush base as a bundle. The brush bristle is attached to the brush base by being bent so that one end side and the other end side of the bundle are put together.

In another aspect of the manufacturing method of the disk-shaped substrate of the present invention, the holding process sandwiches a guide spacer including a portion having a hole at the center thereof and a penetration portion that penetrates a portion between the portion having the hole and the outside thereof between the attached disk-shaped substrates, and the polishing process flows the polishing liquid into the portion having the hole of the disk-shaped substrate via the penetration portion of the guide spacer using the cover member.

In further aspect of the manufacturing method of the disk-shaped substrate of the present invention, the disk-shaped substrates are attached to a substrate holder piling and holding the disk-shaped substrates in the holding process.

BRIEF DESCRIPTION OF THE DRAWINGS

The nature, utility, and further features of the present invention will be more clearly apparent from the following detailed description with respect to preferred embodiments of the invention when read in conjunction with the accompanying drawings briefly described below wherein:

FIG. 11A is a graph showing the experimental result of polishing in the configuration of the present embodiment;

FIG. 11B is a graph showing the experimental result of polishing in the comparative example;

DETAILED DESCRIPTION OF THE EMBODIMENTS

Figure 1A:
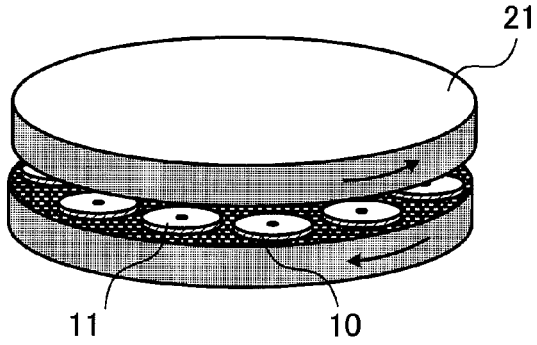
FIGS. 1A to 1H are diagrams illustrating the manufacturing process of a disk-shaped substrate (a disk substrate) to which the exemplary embodiments according to the present invention are applied.
Figure 1B:
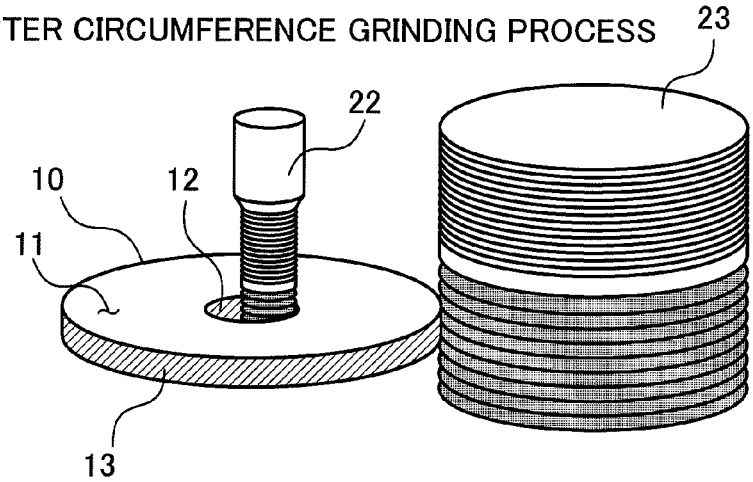
Figure 1C:
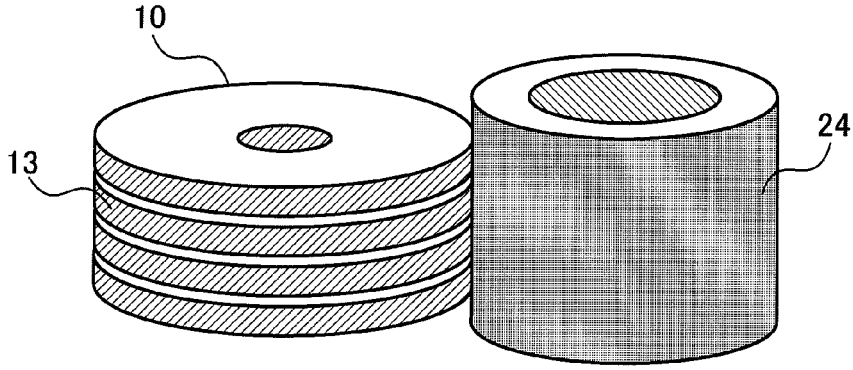
Figure 1D:
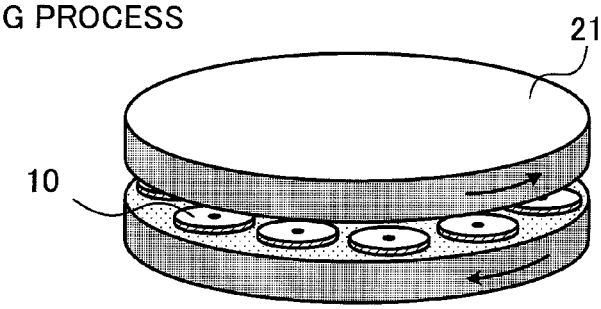

Hereinafter, exemplary embodiments of the present invention will be described in detail with reference to the attached drawings.

FIG. 1A to FIG. 1H are diagrams illustrating the manufacturing process of a disk-shaped substrate (a disk substrate) to which the exemplary embodiments according to the present invention are applied. In this manufacturing process, first, in a first lapping process shown in FIG. 1A, raw materials of disk-shaped substrates 10 (workpieces) are put on a fixed base 21, and flat surfaces 11 of the disk-shaped substrates 10 are ground. At this moment, on the surface of the fixed base 21 on which the disk-shaped substrates 10 are put, for example, abrasives of diamond are dispersed and spread. Next, in an inner and outer circumference grinding process shown in FIG. 1B, a portion having an opening hole 12 formed at the center of the disk-shaped substrate 10 is ground by an inner circumference grind stone 22, and the outer circumference 13 of the disk-shaped substrate 10 is ground by an outer circumference grind stone 23. At this moment, the inner circumferential surface and the outer circumferential surface of the disk-shaped substrate 10 are held and processed at the same time by the inner circumference grind stone 22 and the outer circumference grind stone 23, and thereby coaxial degrees of the inner diameter and the outer diameter are easily secured. Further, in an outer circumference polishing process shown in FIG. 1C, the outer circumferences 13 of the disk-shaped substrates 10 are polished by use of an outer circumference polishing brush 24. Thereafter, in a second lapping process shown in FIG. 1D, the disk-shaped substrates 10 are mounted on the fixed base 21, and the flat surfaces 11 of the disk-shaped substrates 10 are further ground.

Figure 1E:
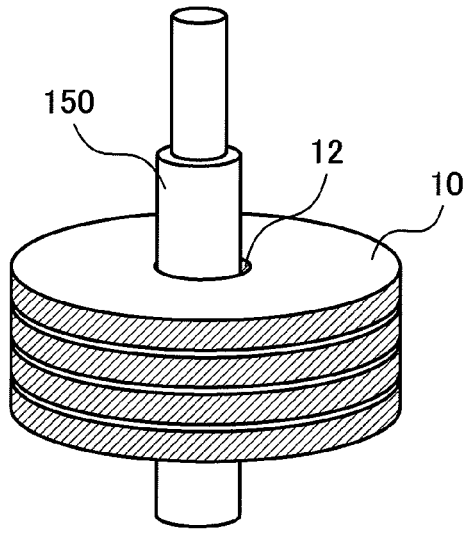

Next, in an inner circumference polishing process shown in FIG. 1E, a polishing brush 150 is inserted into the portions having the opening hole 12 at the center of the disk-shaped substrates 10, and the inner circumferential surfaces of the portions having the opening hole 12 of the disk-shaped substrates 10 are polished. At this time, a polishing brush 150 that satisfies a predetermined condition is used. That is, as the first process of the inner circumference polishing process, an inspection process for the polishing brush 150 is included in the inner circumference polishing process. The inspection process is later described in detail.

Figure 1F:
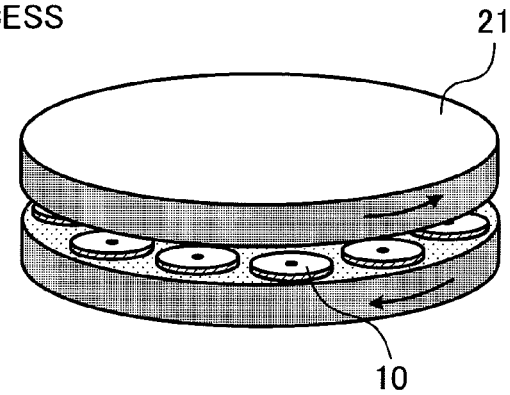
Figure 1G:
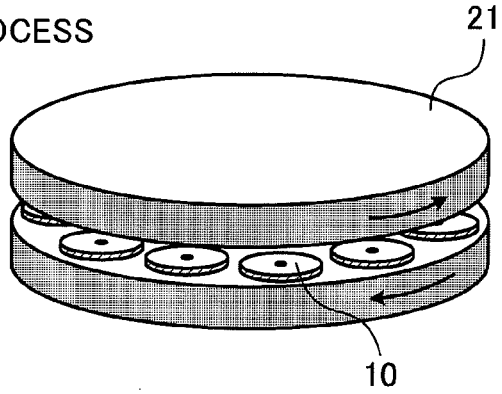
Figure 1H:
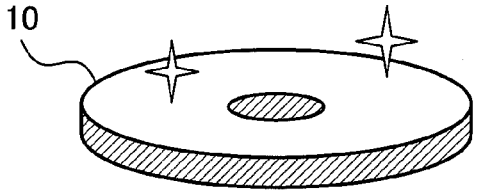

Thereafter, in a first polishing process shown in FIG. 1F, the disk-shaped substrates 10 are mounted on the fixed base 21, and the flat surfaces 11 of the disk-shaped substrates 10 are polished. In the polishing process at this moment, for example, hard polisher is used as non-woven cloth (polishing cloth). Further, in the second polishing process shown in FIG. 1G, the flat surfaces 11 are polished by use of soft polisher. Thereafter, in a final washing and inspection process shown in FIG. 1H, washing and inspection are carried out, and thereby the disk-shaped substrates (disk substrates) 10 are manufactured.

Next, a polishing apparatus used in the above inner circumference polishing process will be described below.

Figure 2:
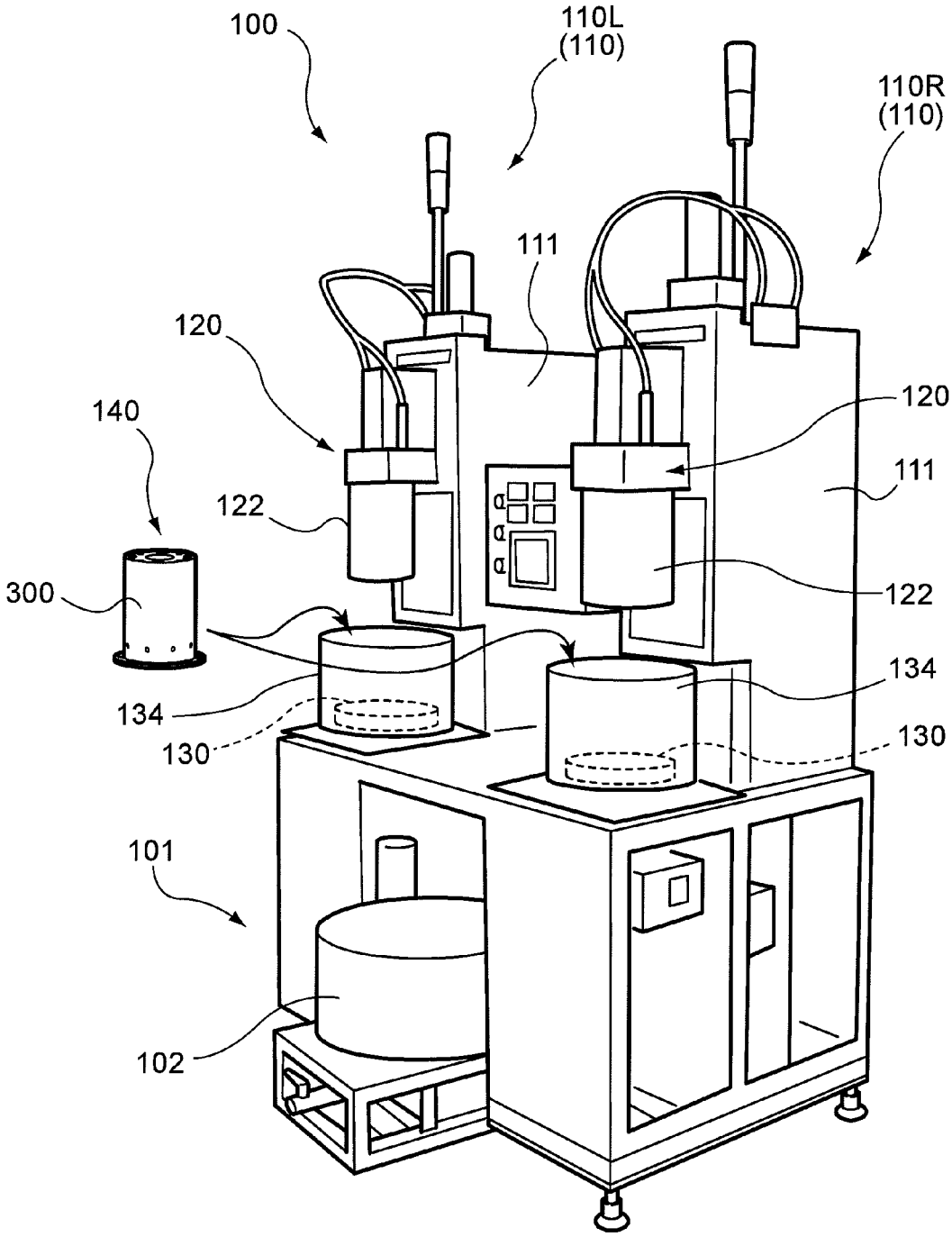
FIG. 2 is a perspective view of appearance of a polishing apparatus.
Figure 3:
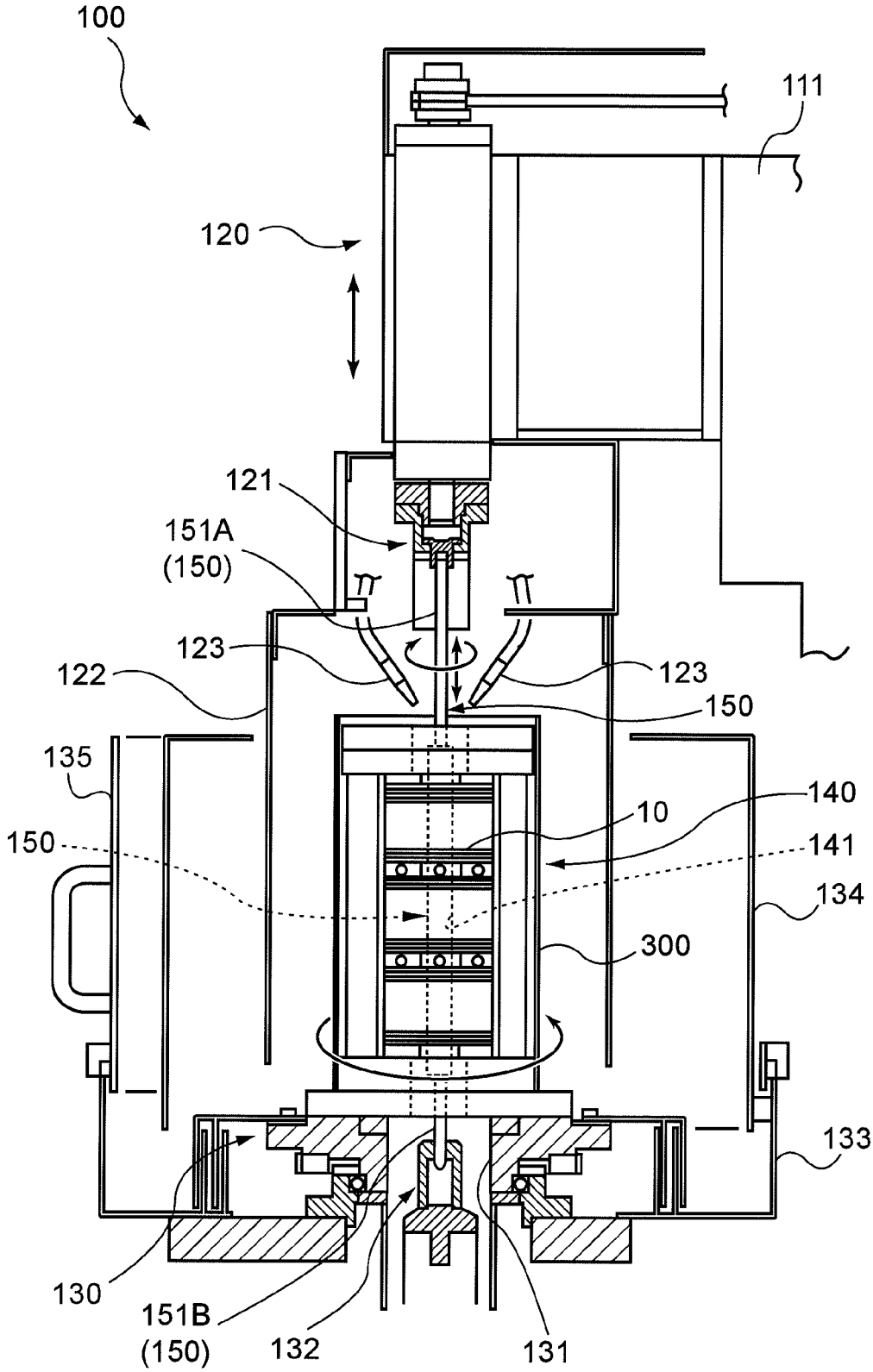
FIG. 3 is a view illustrating a longitudinal section of a polishing mechanism partially.

FIG. 2 is a perspective view of appearance of a polishing apparatus 100, and FIG. 3 is a view illustrating a longitudinal section of a polishing mechanism 110 partially. FIG. 2 shows a preparative state before polishing work where polishing heads 120 of the polishing mechanism 110 are in an up position, while FIG. 3 shows a working state where the polishing head 120 is in a down position. Thus, the position of the polishing head 120 is different between in FIG. 2 and FIG. 3.

In the polishing apparatus 100 shown in FIGS. 2 and 3, piled workpieces 140 configured by piling the plural disk-shaped substrates 10 which are members to be polished (which will be described later) are attached to carry out the polishing work for the piled workpieces 140.

The polishing apparatus 100 is provided with a matched pair of polishing mechanisms 110L on the left and 110R on the right in parallel on a base frame 101. By this arrangement, the polishing work for two sets of the piled workpieces 140 is carried out at the same time. The polishing mechanisms 110L on the left and 110R on the right have similar configurations, and they will be described below as the polishing mechanism 110.

In the base frame 101, a slurry tank 102 that stores slurry which is polishing liquid including separate abrasive is disposed. A pump that circulates and drives the slurry stored in the slurry tank 102, a control apparatus for the polishing apparatus and the like are also provided, although they are not shown in figures.

The polishing mechanism 110 is provided with the polishing head 120 supported movably in the vertical direction of a column 111 provided upright on the base frame 101 and a rotating table 130 disposed below the polishing head. Here, the rotating table 130 is an example of a holding unit.

The polishing head 120 is provided with a chuck 121 that grasps one end of the polishing brush 150 described later, and that vertically supports the polishing brush 150. The chuck 121 is rotated by a driving unit such as a motor that is not shown in the figure.

Around the chuck 121, a cylindrical cover 122 of which bottom end is open is provided while covering the chuck 121 and being suspended to a predetermined height. Inside the cover 122, slurry supply nozzles 123 are provided adjacent to the chuck 121. Tips of the slurry supply nozzles 123 are open toward the upper face of the piled workpieces 140 mounted on the rotating table 130. Here, the slurry supply nozzles 123 are examples of parts of a polishing-liquid flowing-in unit. Further, portions related to the slurry flowing in such as a portion having an opening hole 233C and the portion having the communication clearance 142 described later function as a polishing-liquid flowing-in unit.

The polishing head 120 is provided so as to be reciprocated vertically along the column 111 with a predetermined stroke and is reciprocated by a reciprocation driving unit that is not shown in the figure.

The rotating table 130 is formed from a disk-shaped member with a predetermined diameter so that the piled workpieces 140 are attachable on the upper face thereof. The rotating table 130 is disposed under the polishing head 120 and is rotated with a predetermined rotational speed by a driving unit such as a motor that is not shown in the figure. At the center thereof, an opening 131 with a predetermined diameter is formed. Inside of the opening 131, a support bearing 132 is provided independently of the rotating table 130. The support bearing 132 rotatably supports the other end of the polishing brush 150.

A cylindrical slurry receiver 133 of which an upper end is open and having a bottom is provided so as to cover the periphery and the lower side of the rotating table 130. Moreover, upper part of the slurry receiver 133, a cylindrical cover 134 of which both ends are open is provided. A door 135 is provided so as to be open and close on the front side of the cover 134.

The slurry supply nozzles 123 provided at the polishing head 120 and the slurry receiver 133 provided at the rotating table 130 are connected to the slurry tank 102 provided in the base frame 101 via piping that is not shown in the figure, respectively. Slurry stored in the slurry tank 102 is supplied to the slurry supply nozzles 123, and the slurry received by the slurry receiver 133 is returned to the slurry tank 102. That is, the slurry is circulated from the slurry tank 102 to the slurry supply nozzle 123 and from the slurry receiver 133 to the slurry tank 102.

The polishing mechanism 110 described above supports the piled workpieces 140 on the upper face of the rotating table 130, and supports the upper end of the polishing brush 150 with the chuck 121 of the polishing head 120 as shown in FIG. 3. As the polishing brush 150, a brush having passed an inspection process described later is used.

Then, the polishing brush 150 is inserted into a center portion having a hole 141 of the piled workpieces 140 by lowering the polishing head 120 as a brush insertion process to make a state where the lower end of the polishing brush 150 is supported by the support bearing 132. In this state, the slurry is discharged from the slurry supply nozzles 123 and is supplied onto the upper face of the piled workpieces 140, and the rotating table 130 (and the piled workpieces 140) is rotated. At the same time, the polishing brush 150 is reciprocated with a predetermined stroke in the axial direction (the vertical direction) while being rotated. By this action, the inner circumferential face of the center portion having the hole 141 of the piled workpieces 140 (an inner circumferential surface of the disk-shaped substrate 10) is polished as a polishing process. In the present exemplary embodiment, the rotating direction of the piled workpieces 140 (and the rotating table 130) is set to counterclockwise when it is seen from the above, while the rotating direction of the polishing brush 150 is set to clockwise when it is seen from the above.

In addition, in the present exemplary embodiment, the polishing work is carried out in a state where the cover 300 is mounted on the piled workpieces 140 so as to cover the portion where the disk-shaped substrates 10 are piled.

Figures 4A, 4B:
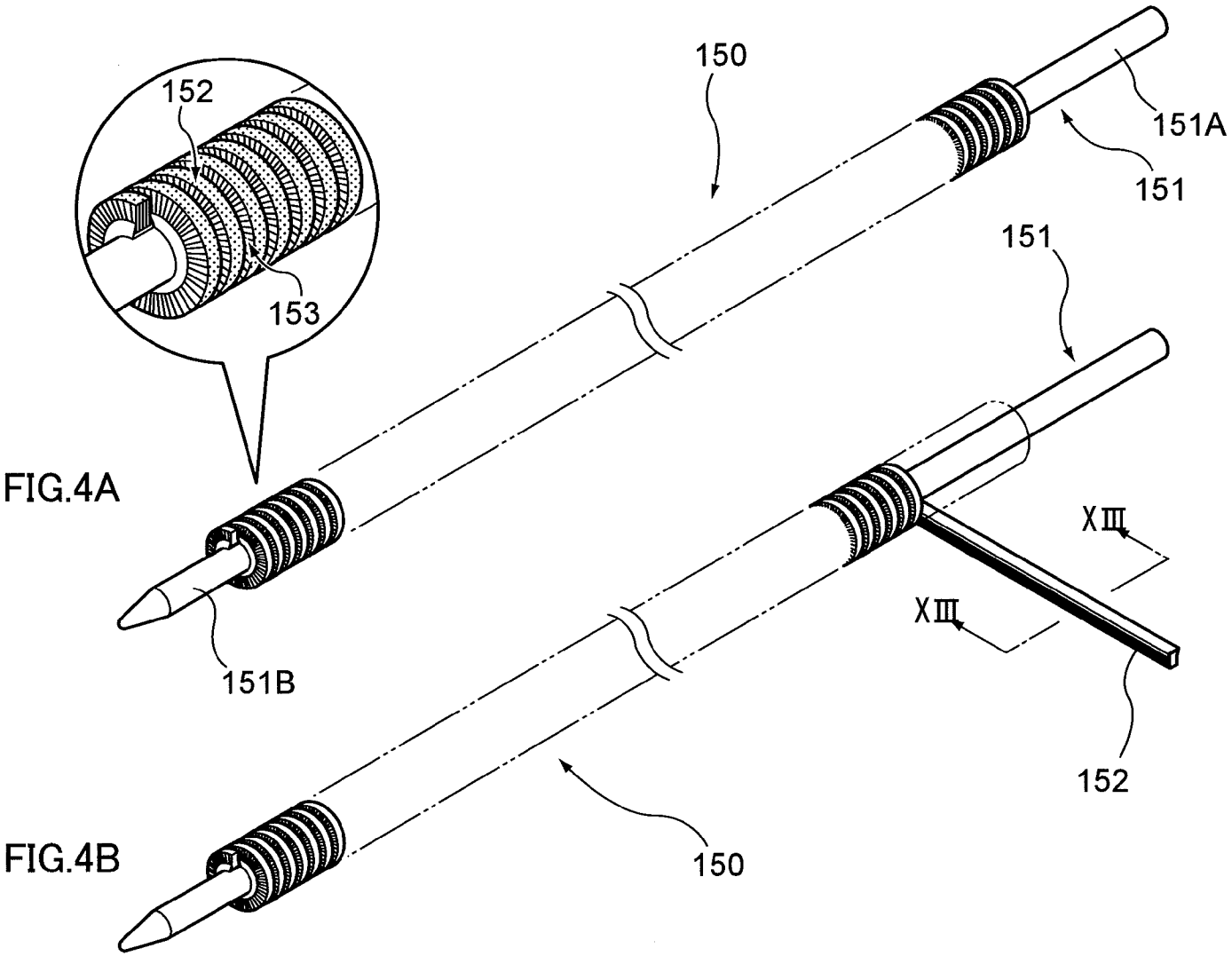
FIG. 4A is an entire perspective view of the polishing brush used in the polishing mechanism.
FIG. 4B is a perspective view illustrating a manufacturing process of the polishing brush.

FIG. 4A is an entire perspective view of the polishing brush 150 used in the polishing mechanism 110, and FIG. 4B is a perspective view illustrating a manufacturing process of the polishing brush 150.

The polishing brush 150, as shown in FIGS. 4A and 4B, is provided with a shaft core 151 which is formed from a stainless steel alloy or the like with a predetermined diameter, and a brush row 152 as a brush base material that is provided spirally with a predetermined pitch around the shaft core 151. A predetermined interval (a portion having a brush clearance 153) is set between the brush row 152. The portion having the brush clearance 153 is formed spirally and continuously in the axial direction similarly to the brush row 152. The spiral direction of the brush row 152 and the portion having the brush clearance 153 is so-called sinistrorse (a direction that moves away counterclockwise) so that the slurry in the portion having the brush clearance 153 may be driven from top to bottom by clockwise rotation.

An outer diameter including a length of the bristle of the polishing brush 150 is set at 13 mm with respect to an inner diameter of 12 mm of a portion having an opening hole 12 of a disk-shaped substrate 10, for example.

Both ends of the shaft core 151 protrude from the brush area with a predetermined length, respectively. One of which is a grasped portion 151A grasped with the chuck 121 and the other is a tapered supported portion 151B supported by the support bearing 132.

Detailed configuration and inspection of the polishing brush 150 will be described later.

Next, the piled workpieces 140 will be described.

Figure 5:
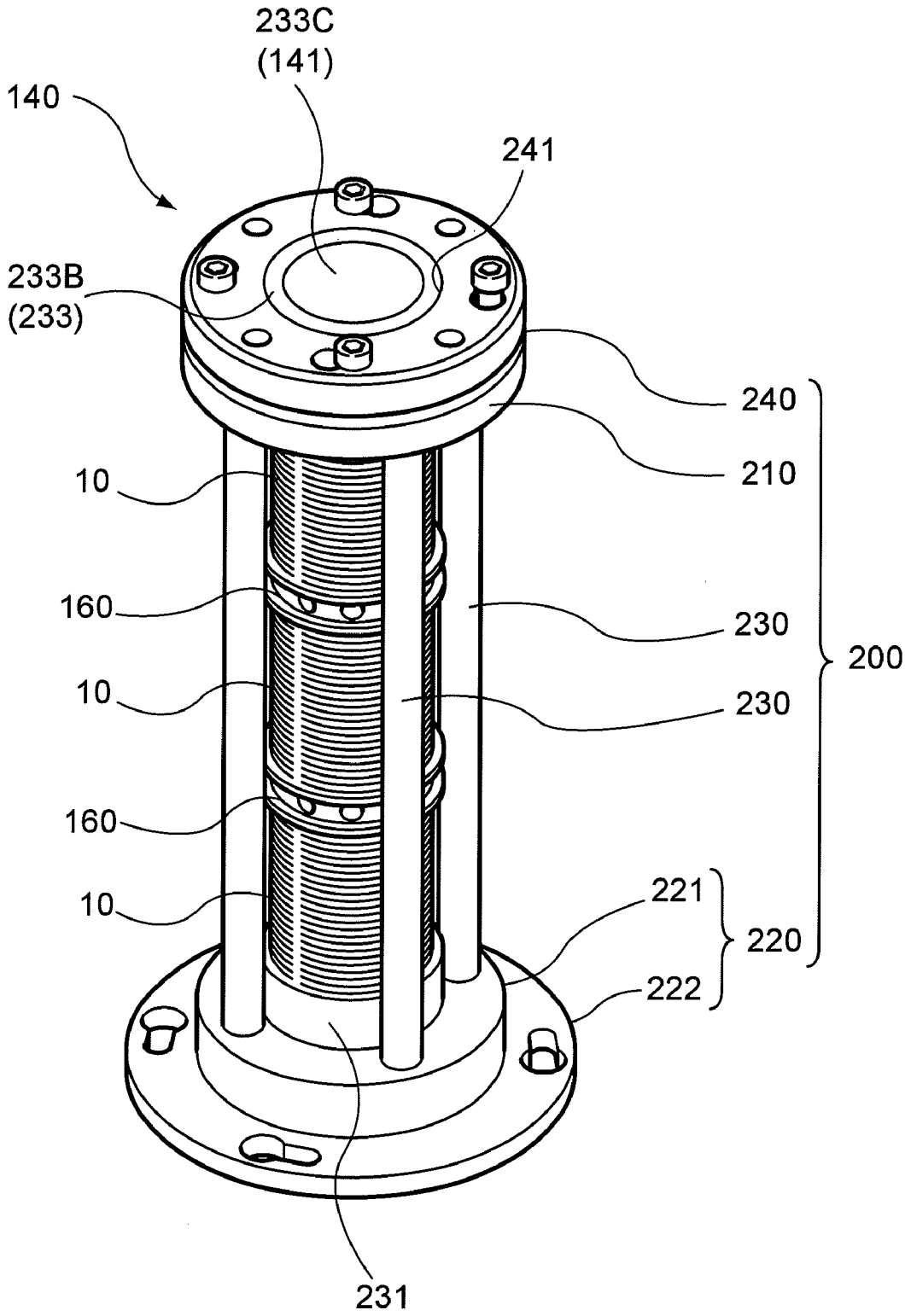
FIG. 5 is an entire perspective view of the piled workpieces.
Figure 6:
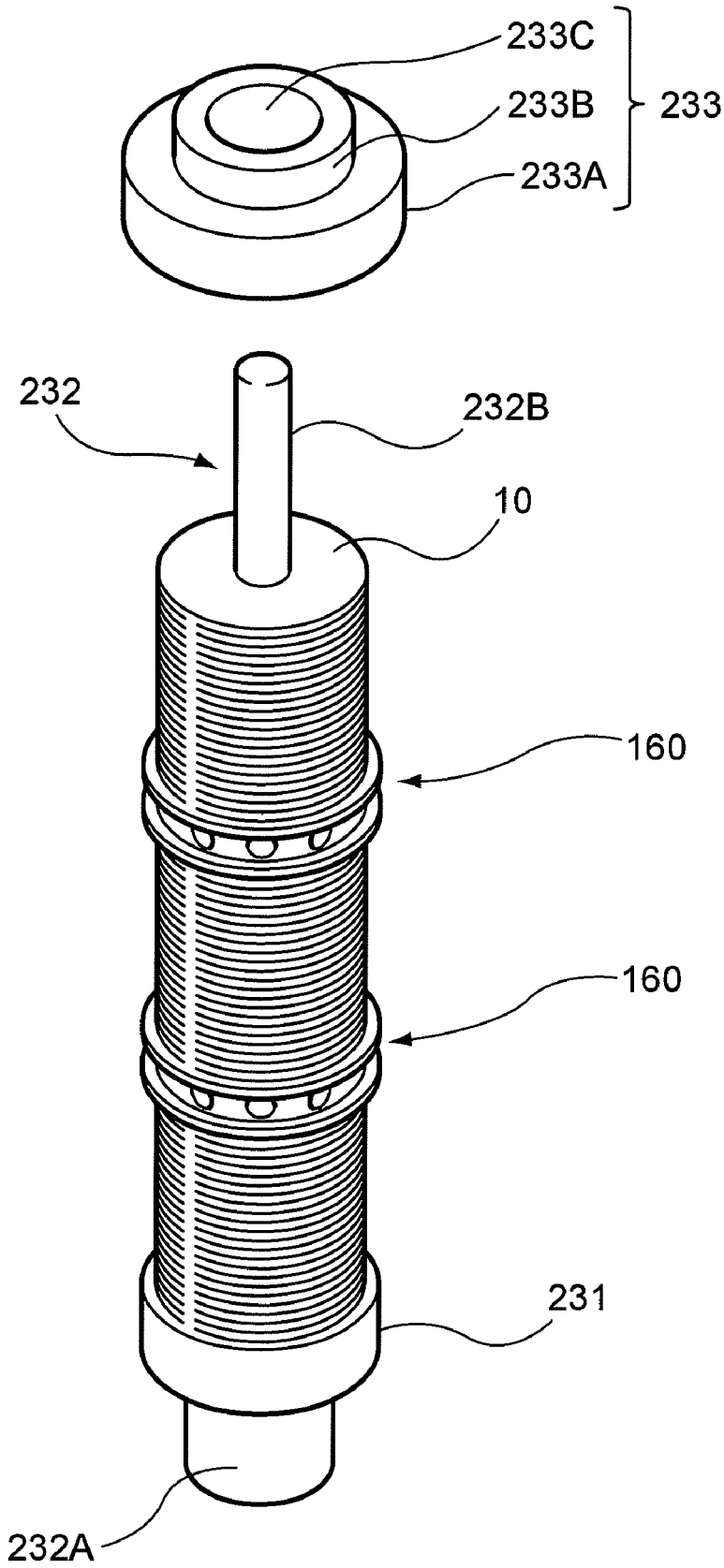
FIG. 6 is a perspective view illustrating a piling process of the disk-shaped substrate for forming the piled workpieces.
Figure 7A:
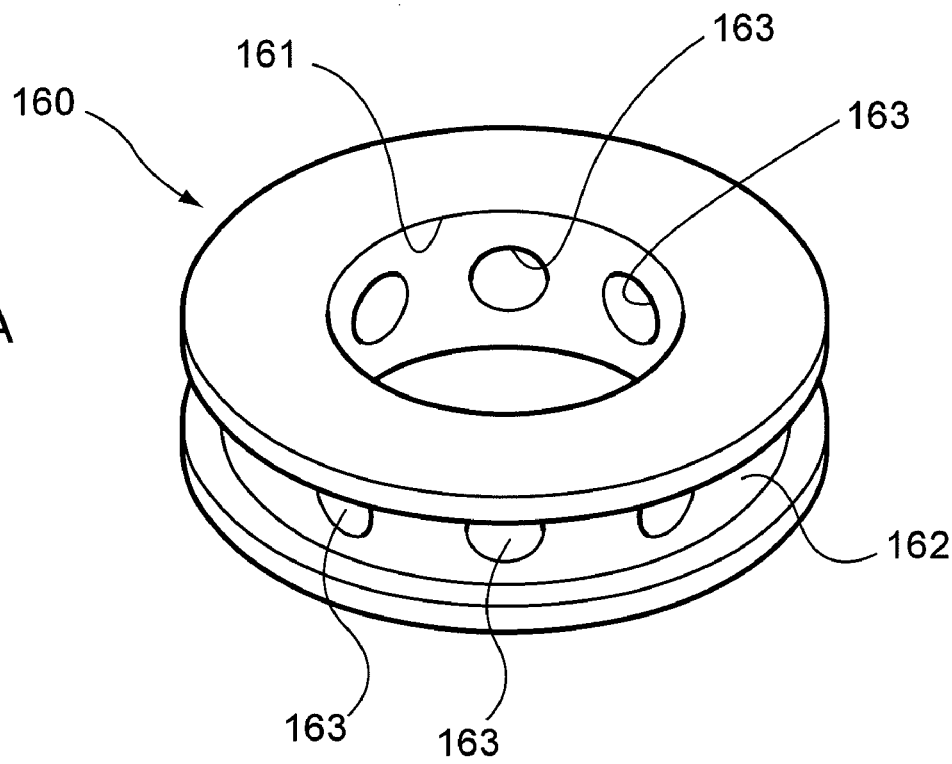
FIG. 7A is a perspective view illustrating a slurry guide spacer inserted into the middle of piling of the disk-shaped substrate.

FIG. 5 is an entire perspective view of the piled workpieces 140, and FIG. 6 is a perspective view illustrating a piling process of the disk-shaped substrate 10 for forming the piled workpieces 140. FIG. 7A is a perspective view illustrating a slurry guide spacer 160 inserted into the middle of piling of the disk-shaped substrate 10, and FIG. 7B is a sectional view of the slurry guide spacer 160.

Figure 7B:
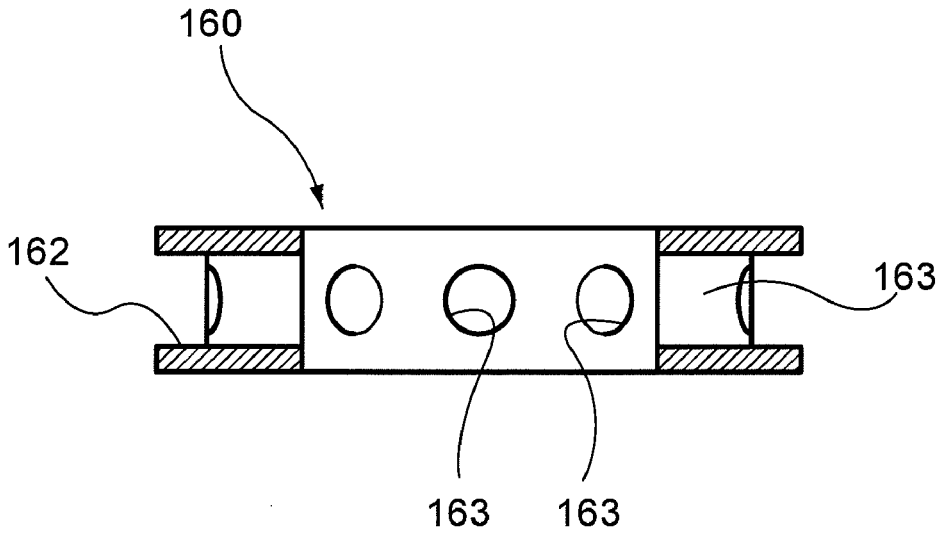
FIG. 7B is a sectional view of the slurry guide spacer.

Among the piled workpieces 140 shown in FIG. 5, the slurry guide spacers 160 that are shown in FIGS. 7A and 7B are held as shown in FIG. 6, and the piled workpieces 140 are supported by a holder 200 in which a large number (150 pieces, for example) of the disk-shaped substrates 10 are piled.

The holder 200 is configured by connecting upper and lower support disks (an upper support disk 210 and a lower support disk 220) with connecting bars 230 arranged in plural numbers (for example, four connecting bars) in the circumferential direction with a predetermined interval. The piled disk-shaped substrates 10 are placed in a space formed by the upper support disk 210, the lower support disk 220 and the connecting bars 230 (inside of the holder 200), and the piled disk-shaped substrates 10 are fixed to the holder 200 by a fixed disk 240 tightly attached to the upper side of the upper support disk 210. The holder 200 is formed from stainless steel alloy or the like.

The upper support disk 210 on the upper side is a disk-shaped member with a predetermined thickness, and a portion having an opening hole 211 at the center thereof for mounting the piled disk-shaped substrates 10 inside is formed.

The lower support disk 220 on the lower side is provided with a mounting flange 222 with a large diameter under a disk portion 221 with a predetermined thickness. At the center, a portion having an opening hole 223 is formed for communication of the slurry and for insertion of the polishing brush 150. The diameter of the disk portion 221 is set a predetermined length larger than the diameter of the upper support disk 210.

The fixed disk 240 is a disk-shaped member with a diameter that is approximately the same as that of the upper support disk 210 and with a predetermined thickness, and a fitting portion having a fitting hole 241 to be fitted with an upper presser 233, which will be described later, is formed at the center. Moreover, the fixed disk 240 is fixed by a bolt on the upper support disk 210 with the centers aligned.

To the holder 200, the disk-shaped substrates 10 that are piled by using a centering shaft 232 as a piling jig is mounted as shown in FIG. 6.

That is, a lower presser 231 is inserted into the centering shaft 232 and attached thereto, and then, the disk-shaped substrates 10 are sequentially fitted so that the disk-shaped substrates 10 are piled while being positioned with the portions having an opening hole 12 at the center thereof as a reference. Finally, the upper presser 233 is inserted into the centering shaft 232 and attached thereto. By this arrangement, the piled disk-shaped substrates 10 fitted in the centering shaft 232 are sandwiched between the lower presser 231 and the upper presser 233.

The lower presser 231 is a disk-shaped member with an outer diameter that is substantially equal to or larger than the outer diameter of the disk-shaped substrate 10 and with a predetermined thickness. The inner diameter thereof is set larger than the inner diameter of the disk-shaped substrate 10.

The upper presser 233 is formed as a double-staged profile by forming a small-diameter portion 233B on a body portion 233A with an outer diameter substantially equal to that of the disk-shaped substrate 10. At the center, a portion having an opening hole 233C is formed for communication of the slurry and for insertion of the polishing brush 150.

The upper presser 233 and the lower presser 231 are formed from a resin such as polyacetal or the like.

The centering shaft 232 has a large-diameter portion 232A to be fitted in the portion having the opening hole 223 of the lower support disk 220 (See FIG. 9 for reference) at the lower end and a medium-diameter portion (not shown in the figure) fitted in the inner diameter of the lower presser 231 thereon. Further, a positioning shaft portion 232B to which the disk-shaped substrates 10 are fitted is provided on the medium-diameter portion.

The piled disk-shaped substrates 10 fitted in the centering shaft 232 as described above are inserted into the holder 200 and placed inside via an portion having an opening hole of the upper support disk 210 (see the portion having the opening hole 211 shown in FIG. 9 for reference, which will be described later) from the top in FIG. 5. Further, the piled disk-shaped substrates 10 are pressed to the lower support disk 220 by the fixed disk 240 tightly attached to the upper side of the upper support disk 210 and are fixed. At this time, the fitting portion having the fitting hole 241 provided in the fixed disk 240 is fitted with the small-diameter portion 233B of the upper presser 233.

The centering shaft 232 is removed from the bottom in FIG. 5 after the piled disk-shaped substrates 10 are fixed.

By this action, the center portion having the hole 141 (see FIG. 5 and FIG. 9 which will be described later for reference) is formed by the portions having the opening hole 12 of the piled disk-shaped substrates 10. The upper end of the center portion having the hole 141 is connected with the portion having the opening hole 233C provided in the upper presser 233 of which upper end is open, while the lower end of the center portion having the hole 141 is connected with the portion having the opening hole 223 provided in the lower support disk 220 via the inner-diameter portion (not shown in the figure) of the lower presser 231.

Here, the slurry guide spacers 160 are provided among the disk-shaped substrates 10 piled in the holder 200 per predetermined number of pieces. The slurry guide spacer 160 is provided by being inserted among the disk-shaped substrates 10 per the predetermined number of pieces when the disk-shaped substrates 10 are sequentially fitted with the above-mentioned centering shaft 232. In the present exemplary embodiment, two slurry guide spacers 160 are inserted so as to divide the thickness of the entire piled disk-shaped substrates 10 into three parts of which thickness are equal to each other. If 150 pieces of the disk-shaped substrates 10 are piled, for example, one slurry guide spacer 160 is sandwiched in every 50 pieces.

The slurry guide spacer 160 is made of a resin, for example, polyacetal or the like. As shown in FIGS. 7A and 7B, the slurry guide spacer 160 is formed in a disk shape with an outer diameter that is substantially equal to that of the disk-shaped substrate 10 and with a predetermined thickness. At the center, a portion having an opening hole 161 with a dimension larger than the inner diameter of the disk-shaped substrate 10 is formed, and a portion having a groove 162 with a predetermined depth is formed on the outer circumferential surface. Moreover, a supply portion having an opening hole 163 with a predetermined diameter is provided with communication between the bottom (outer circumferential surface) of the portion having the groove 162 and the inner circumferential surface of the portion having the opening hole 161. The supply portion having the opening hole 163 is provided in plural numbers (for example, 8 portions (at intervals of 45 degrees)) with an equiangular interval in the circumferential direction of the portion having the groove 162.

Next, polishing work using the cover 300 will be described.

Figure 8:
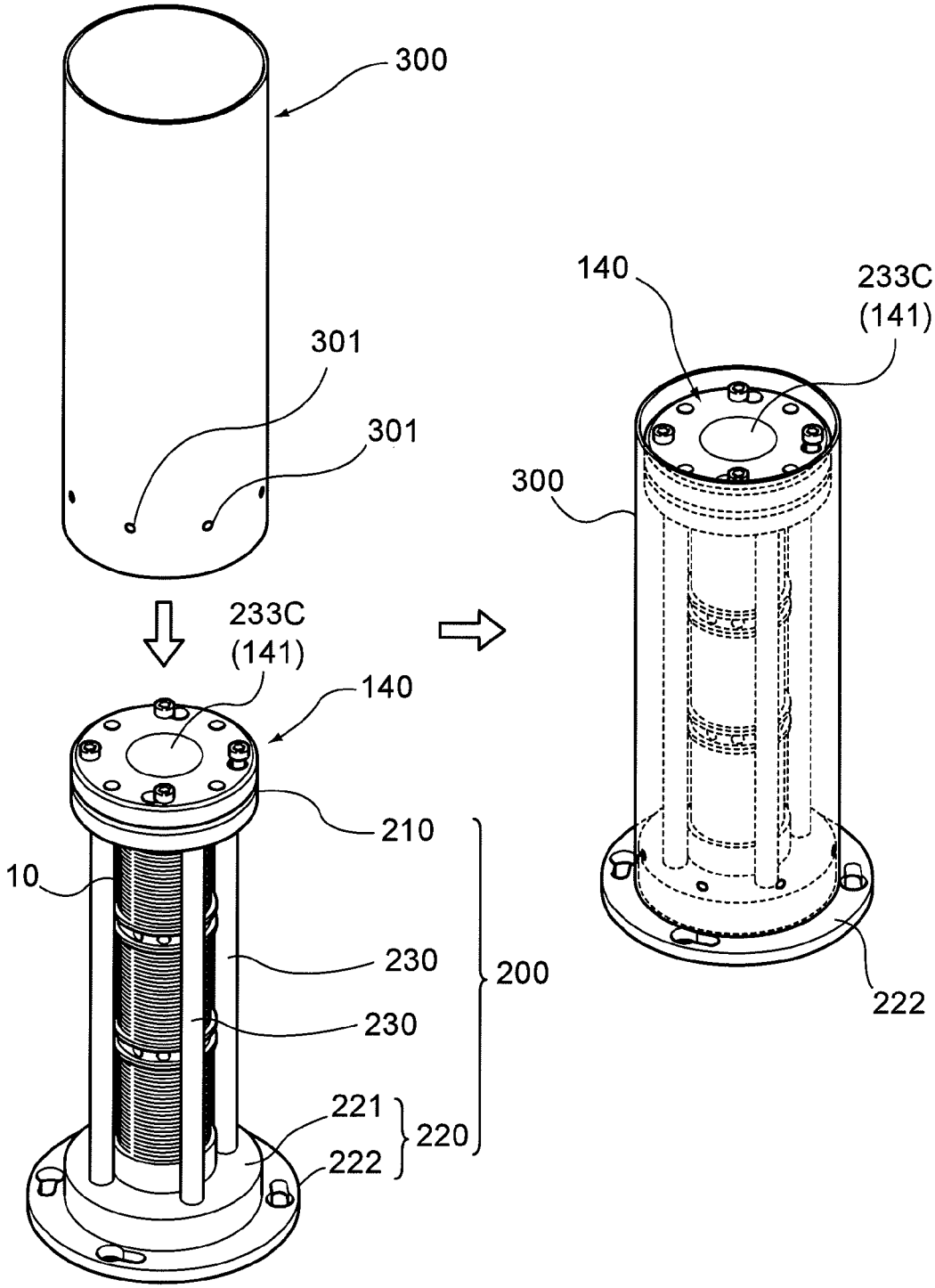
FIG. 8 is a view for illustrating attachment of the cover to the piled workpieces.
Figure 9:
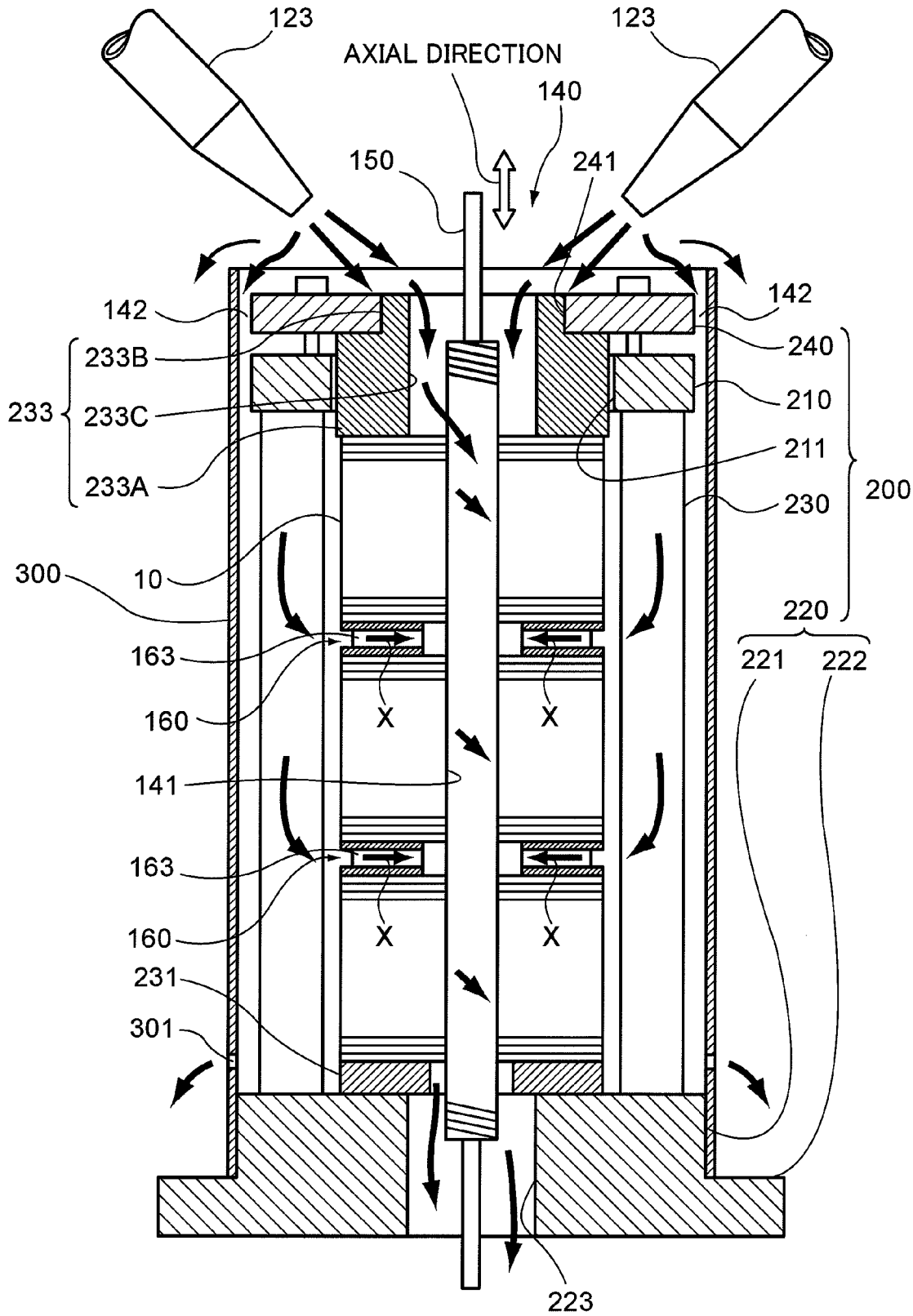
FIG. 9 is a sectional view of the piled workpieces during the polishing work.

FIG. 8 is a view for illustrating attachment of the cover 300 to the piled workpieces 140. Further, FIG. 9 is a sectional view of the piled workpieces 140 during the polishing work.

In the exemplary embodiment, the polishing work is carried out in a state where the cover 300 is mounted on the piled workpieces 140 in which a large number of disk-shaped substrates 10 are piled and is placed in the holder 200 so as to cover the portion where the disk-shaped substrates 10 are piled.

The cover 300 is formed cylindrically (straight pipe shaped) so that the upper and lower ends are open, and is made from, for example, a thin-sheet shaped resin film or the like. Besides the case where the cover is formed cylindrically from the beginning, the cover may be formed by rounding a rectangular resin film sheet at the time of attaching and bonding the both ends, for example. The inner diameter is fitted with the disk portion 221 of the lower support disk 220 in the holder 200 substantially without a gap. The height of the cover 300 is set to be a predetermined length larger than a height from the upper side of the mounting flange 222 of the lower support disk 220 in the holder 200 to the upper side of the upper support disk 210. In addition, in the vicinity of one end of the cover 300 (in the vicinity of a lower edge), plural portions having a drain hole 301 with a predetermined diameter are provided in the circumferential direction with a predetermined interval.

As shown in FIG. 8, the cover 300 formed as the above is fitted with the piled workpieces 140 so as to cover the workpieces 140 from the top, and is mounted in such a manner that the lower end of the cover 300 is fitted in the disk portion 221 of the lower support disk 220 in the holder 200 substantially without a gap.

At a state in which the cover 300 is mounted on the piled workpieces 140, the upper end of the cover 300 is higher than the upper side of the piled workpieces 140 by a predetermined length. As shown in FIG. 9, a portion having a communication clearance 142 with a predetermined width is formed between the inner circumference of the cover 300 and the side circumferential surface of the upper support disk 210. This is because the diameter of the disk portion 221 of the lower support disk 220 is formed larger than the diameter of the upper support disk 210, and the cover 300 is formed in the straight pipe shape with the diameter corresponding to the outer diameter of the disk portion 221 of the lower support disk 220. With regard to the holder 200 in which the upper support disk 210 and the disk portion 221 of the lower support disk 220 are formed with the same diameter, the portion having the communication clearance 142 is preferably formed by forming the cover 300 in the tapered shape of which the upper part is expanded, for example.

Moreover, the portions having the drain hole 301 that are formed at the lower part of the cover 300 and that are provided for draining the slurry are located above the upper side of the disk portion 221 of the lower support disk 220 in a state where the cover 300 is mounted.

As mentioned above, the cover 300 is provided with the portions having the drain hole 301 for draining the slurry, while a lower opening at the lower end of the cover 300 is blocked by the lower support disk 220 of the holder 200 to cover the periphery of the piled workpieces 140 (the piled workpieces 140 is placed inside), and forms a cylindrical container shape where upper end of the cover 300 is open.

The piled workpieces 140 to which the cover 300 is mounted as described above is mounted on the rotating table 130 by tightly attaching a mounting flange 222 of the lower support disk 220 of the holder 200 to the rotating table 130 of the polishing mechanism 110 with a bolt. The configuration having been described in which the disk-shaped substrates 10 are piled and supported in the holder 200 and attached to the rotating table 130 is one of functions of a holding unit. The attaching process of the cover 300 is not limited to the above, but the cover 300 may be placed over the piled workpieces 140 after the piled workpieces 140 are mounted on the rotating table 130.

Next, the polishing work and flow of the slurry during the polishing work will be described referring to FIG. 9.

The polishing work is carried out by having the slurry discharged from the slurry supply nozzles 123 and supplying the slurry to the upper side of the piled workpieces 140, rotating the rotating table 130 and rotating the polishing brush 150 while reciprocating the polishing brush 150 in the axial direction (the vertical direction) with a predetermined stroke.

The slurry having been supplied to the upper side of the piled workpieces 140, as shown by arrows in FIG. 9, flows from the portion having the opening hole 233C of the upper presser 233 of which upper end is open at the upper part of the holder 200 into the center portion having the hole 141 of the piled workpieces 140, while passing through the portion having the communication clearance 142 so as to flow between the outer circumference of the piled workpieces 140 and the cover 300. Excess slurry which has not flown into these paths overflows outside from the upper edge of the cover 300 and flows down along the outer circumferential surface.

The slurry that has flown into the center portion having the hole 141 of the piled workpieces 140 is fed downward by the brush bristle material of the polishing brush 150 (see a brush bristle material 154 in FIG. 12 for reference, which will be described later) formed spirally, by rotation of the polishing brush 150, and further, by self-weight of the slurry, and the slurry flows out of the portion having the opening hole 223 of the lower support disk 220. The slurry flows through the portion having the communication clearance 142, flows between the outer circumference of the piled workpieces 140 and the cover 300, flows down along the outer surface of the piled workpieces 140, and part thereof flows out of the portion having the drain hole 301 at the lower part of the cover 300.

As mentioned above, the slurry is made to flow along the outer surface of the piled workpieces 140, and the slurry is also supplied from the outer surface to the center portion having the hole 141. By this arrangement, to the polishing work area (the inner circumferential surface of the center portion having the hole 141) by the polishing brush 150, not only the slurry flowing from the portion having the opening hole 211 provided in the upper support disk 210 but also the slurry from the outer circumferential side is supplied.

That is, by pressure change caused by relative movement between the polishing brush 150 and the piled workpieces 140, as shown by arrows X in FIG. 9, the slurry on the outer circumferential side of the piled workpieces 140 is supplied to the polishing work area via the supply portion having the opening hole 163 of the slurry guide spacer 160.

By this arrangement, fresh slurry is supplied not only from the upper end of the piled workpieces 140 but also from the middle (every 50 pieces, for example) of the piled workpieces 140 to the lower polishing work area. Therefore, the inner circumferential surface of the center portion having the hole 141 of the piled workpieces 140 (inner circumferential surface of the disk-shaped substrates 10) may be polished more evenly in the vertical direction. Moreover, since more slurry is supplied to the polishing work area, efficiency of the polishing work is improved, and time for polishing work may be reduced.

Here, supply of the slurry to the polishing work area via the supply portion having the opening hole 163 provided in the slurry guide spacer 160 only needs the slurry outside of the supply portion having the opening hole 163. Therefore, in the present exemplary embodiment, it is only necessary that the slurry flows down along the outer circumferential surface of the piled workpieces 140 to positions where two slurry guide spacers 160 are located. That is, it is not necessary that the entire cover 300 is filled with slurry and the piled workpieces 140 are fully soaked therein.

The interval of the portion having the communication clearance 142 for flowing the slurry between the outer circumference of the piled workpieces 140 and the cover 300, and the diameter and number of the portion having the drain hole 301 formed in the vicinity of the lower edge of the cover 300 are set so that the slurry is favorably supplied by the action.

Next, the inner circumference polishing process performed by the above polishing apparatus 100 will be described in more detail.

Figure 10:
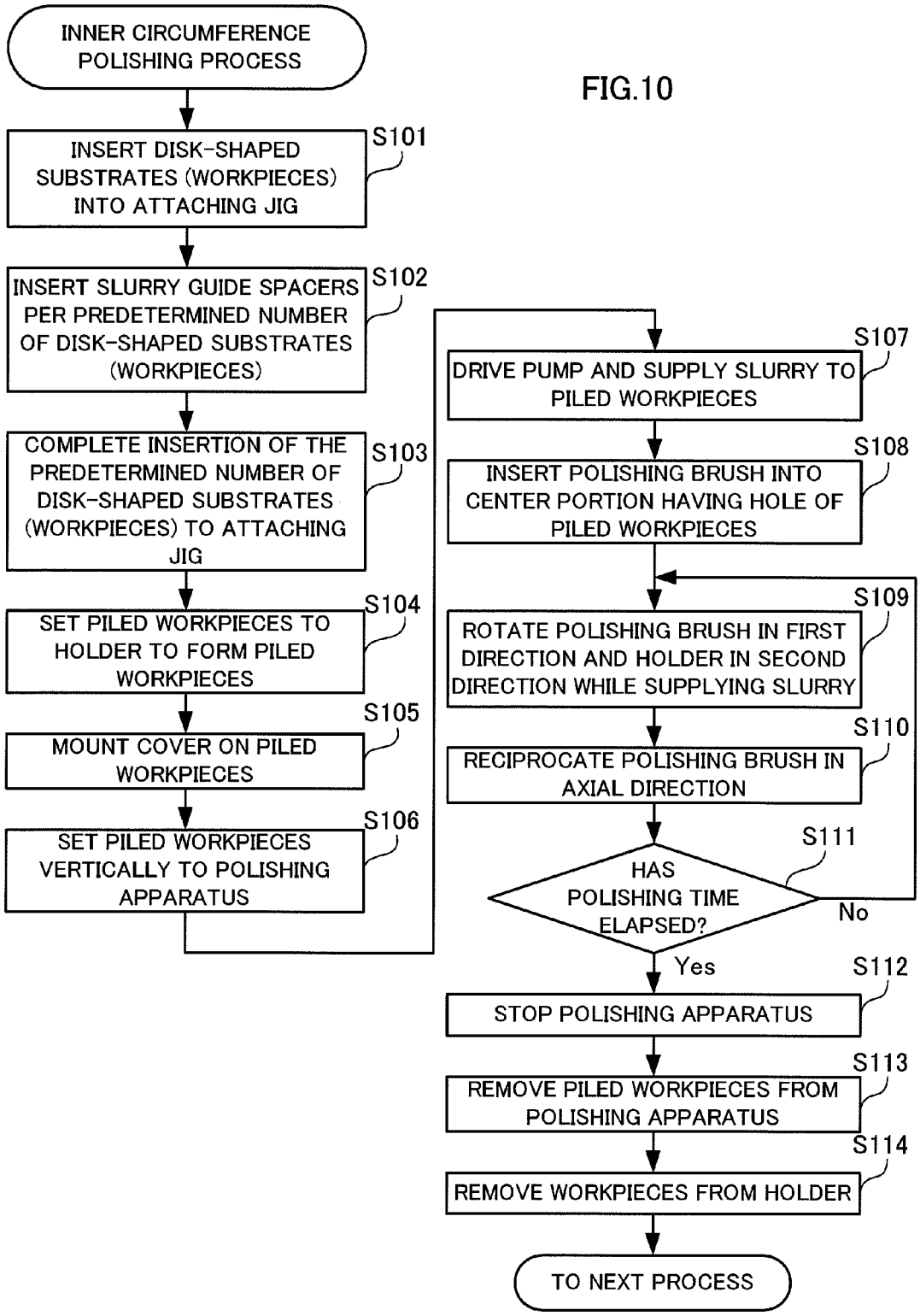
FIG. 10 is a flowchart illustrating a flow of the inner circumference polishing process.

FIG. 10 is a flowchart illustrating a flow of the inner circumference polishing process.

In the inner circumference polishing process, first, the disk-shaped substrates 10 are inserted into an attaching jig (the centering shaft 232) and sequentially piled therein (step 101).

Here, the slurry guide spacers 160 are inserted per predetermined number of disk-shaped substrates 10 (for example, 50 pieces) (step 102), and piling of the predetermined number of disk-shaped substrates 10 (for example, 150 pieces) is finished (Step 103).

Next, the disk-shaped substrates 10 piled on the attaching jig are set in the holder 200 to form the piled workpieces 140 (step 104).

Then, the cover 300 is mounted on the piled workpieces 140 (step 105).

The piled workpieces 140 on which the cover 300 is mounted is stood vertically and mounted on the rotating table 130 of the polishing apparatus 100 (step 106).

Through above steps, the attaching of piled workpieces 140 to the polishing apparatus 100 is finished.

As mentioned above, the process in which the cover 300 is mounted on the piled workpieces 140 at the step 105 may be performed after a process in which the piled workpieces 140 is mounted on the rotating table 130 of the polishing apparatus 100 at the step 106. Attachment of the polishing brush 150 to the polishing head 120 in the polishing apparatus 100 (grasping of the polishing brush 150 by the chuck 121) may be set before or after the above process as appropriate.

Next, the pump is driven to discharge the slurry from the slurry supply nozzles 123 to the upper side of the piled workpieces 140 so as to supply the slurry (step 107). Then, while the slurry flows down the center portion having the hole 141 of the piled workpieces 140 and the inside of the cover 300 (the outer circumferential surface of the piled workpieces 140), the polishing head 120 of the polishing mechanism 110 is lowered, and the polishing brush 150 supported by the polishing head 120 is inserted into the center portion having the hole 141 of the piled workpieces 140 (step 108).

In this state, while the slurry is being supplied, the polishing brush 150 is rotated in a predetermined direction (a first direction), and the piled workpieces 140 having the holder 200 (and the rotating table 130) is rotated in a direction (a second direction) opposite to that of the polishing brush 150 for polishing (step 109). At this time, as shown by an outline arrow in FIG. 9, the polishing brush 150 is reciprocated in the axial direction (the vertical direction) of the piled workpieces 140 (step 110). By this reciprocation, the position of the polishing brush 150 in contact with the piled workpieces 140 is changed, and biased polishing caused by polishing the same spot on the piled workpieces 140 with the same position of the polishing brush 150 is prevented, which leads to more even polishing. The polishing work is carried out for a predetermined polishing time (step 111), and when the polishing time has elapsed, the polishing apparatus is stopped (step 112). If the polishing time has not elapsed, the processing is repeated by returning to step 109.

After that, the piled workpieces 140 are removed from the rotating table 130 (step 113), and moreover, the disk-shaped substrates 10 are removed from the holder 200 in the process opposite to that at the time of mounting (step 114).

Figure 17:
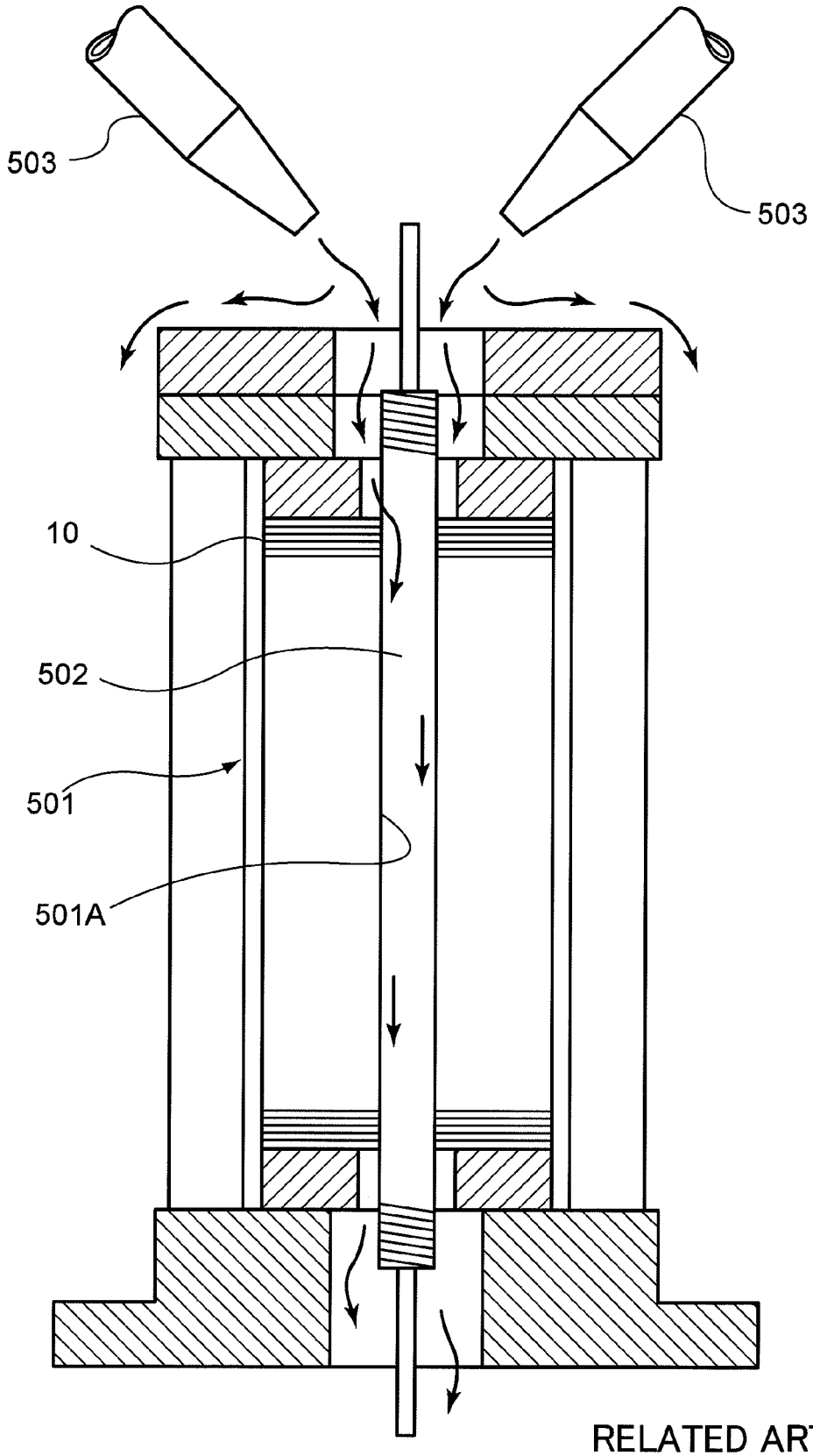
FIG. 17 shows an example of a conventional method of polishing an inner circumferential surface of a disk-shaped substrate according to the related art.

Next, results of comparative experiments using the configuration of the present exemplary embodiment (hereinafter referred to as the configuration of the present embodiment) and a comparative example which is a conventional configuration shown in FIG. 17 will be described below.

In the experiments, the polishing work is carried out under the following conditions and then, the total or predetermined number of disk-shaped substrates 10 is sampled for measurement of the diameter of the inner circumference.

In the configuration of the present embodiment, 150 pieces of the disk-shaped substrates 10 are piled and the slurry guide spacers 160 are set per 50 pieces. That is, two slurry guide spacers 160 are used.

FIG. 11A is a graph showing the experimental result of polishing in the configuration of the present embodiment. FIG. 11B is a graph showing the experimental result of polishing in the comparative example. The lateral axis indicates the positions of the piled disk-shaped substrates 10 (from the top to the bottom), while the vertical axis indicates the inner diameter of the polished surface (the inner diameter of the disk-shaped substrates 10). For the configuration of the present embodiment, a total of nine tests represented by a-1 to a-9 are conducted, while for the comparative example, a total of three tests represented by b-1 to b-3 are conducted.

The experimental conditions (in common) are as follows:

(i) Disk-Shaped Substrate (1.89 inch Glass Magnetic Disk)
Material: Crystallized glass
Outer diameter: 48 mm
Inner diameter: 12 mm
Thickness: 0.7 mm (ii) Piled Workpieces
Number of the piled disk-shaped substrates: 150
Number of the measured samples: 55 (extracted) or 150 (total)
Rotation number: 55 rpm (iii) Polishing Brush used
Outer diameter: Φ13 mm
Material: 66-nylon
Wire diameter: 0.90 mm
Rotation number: 1500 rpm
Oscillating velocity: 240 mm/minute (iv) Polishing Brush Bending Length
0.5 mm This polishing brush bending length indicates a length by which the center of the polishing brush 150 is displaced (cut in) with respect to the center of the piled workpieces 140.

(v) Slurry (Polishing Liquid)
Relative density: 1.2

(vi) Processing Time
14 to 28 minutes (the processing time was set based on a predetermined polishing amount)

As the results of the experiments, in the comparative example (conventional configuration) shown in FIG. 11B, a difference of the inner diameter is approximately 5/1000 mm depending on an arrangement positions where each of the disk-shaped substrates 10 are located (the position of the upper part or the lower part). On the other hand, in the configuration to which the exemplary embodiment is applied, the difference of the inner diameter between the upper part and the lower part is approximately 2.5/1000 mm or less, and the difference is less than that of the comparative example. The average time required for processing of a predetermined polishing amount is approximately 25.3 minutes for the comparative example, while it is reduced to approximately 19.2 minutes for the present exemplary embodiment which is approximately 75% of the average time of the comparative example. This verifies effectiveness of the configuration.

Even in the configuration of the present embodiment, the inner diameter of the disk-shaped substrates 10 at the lower part tends to be smaller. This may be improved by biasing the set position of the slurry guide spacers 160 to the lower side or by increasing the number thereof so as to promote supply of the slurry to the lower part.

Next, the polishing brush 150 to which the present exemplary embodiment is applied will be described in detail with reference to the above-mentioned FIGS. 4A and 4B and FIGS. 12 to 14.

Figure 12:
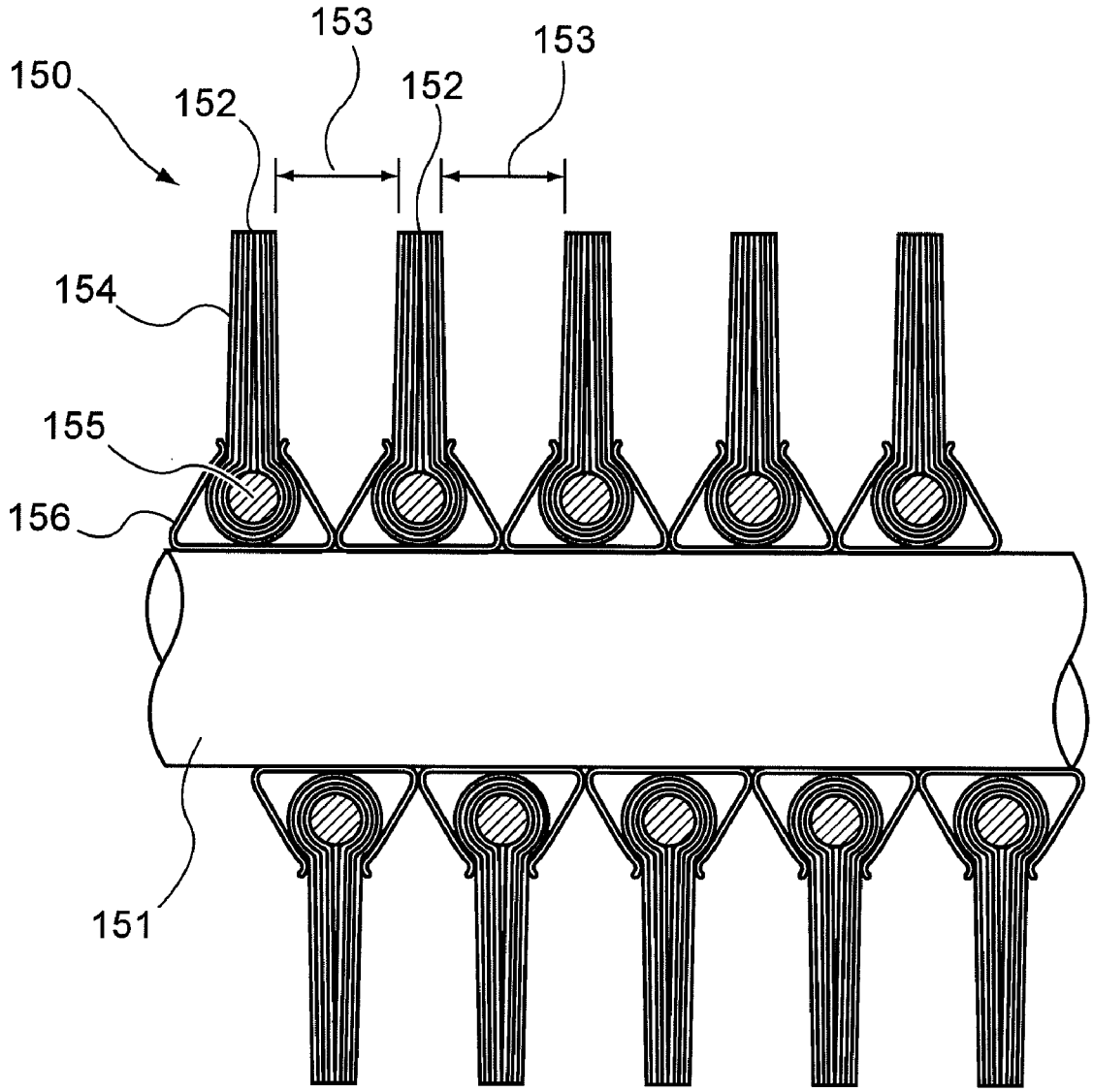
FIG. 12 is an enlarged sectional view illustrating part of the polishing brush in the axial direction.
Figure 13B:
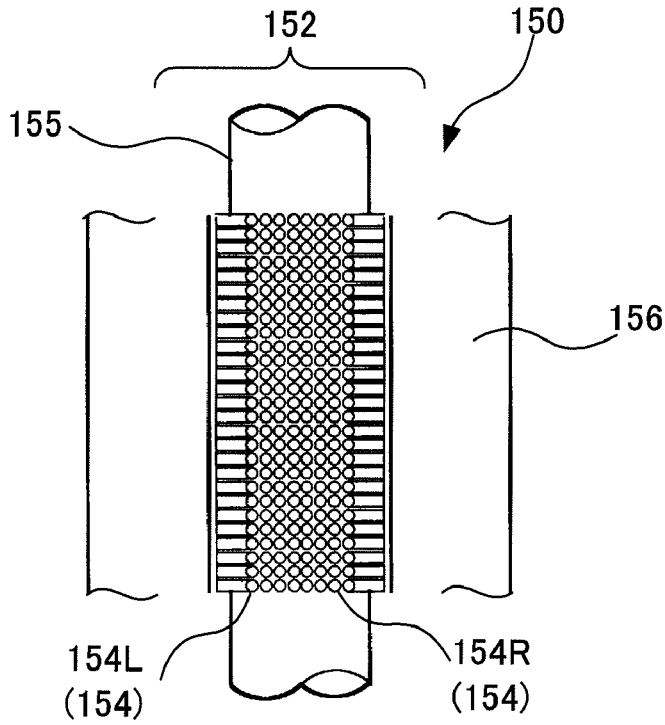
FIG. 13B is a plain view of FIG. 13A.
Figure 13A:
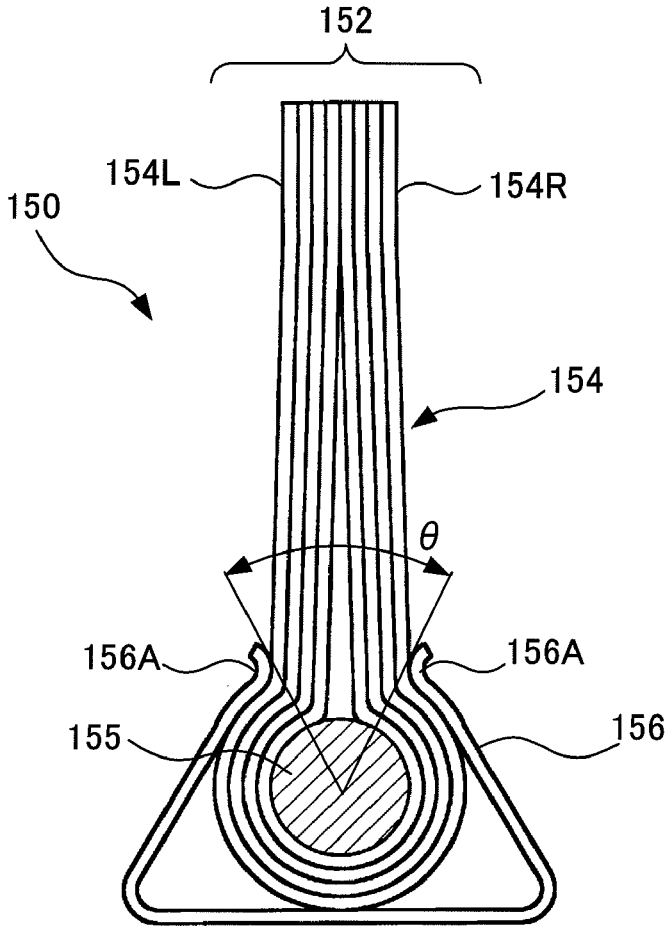
FIG. 13A is an enlarged sectional view of a XIII-XIII line in FIG. 4B (however, it is shown upside down)
Figure 14B:
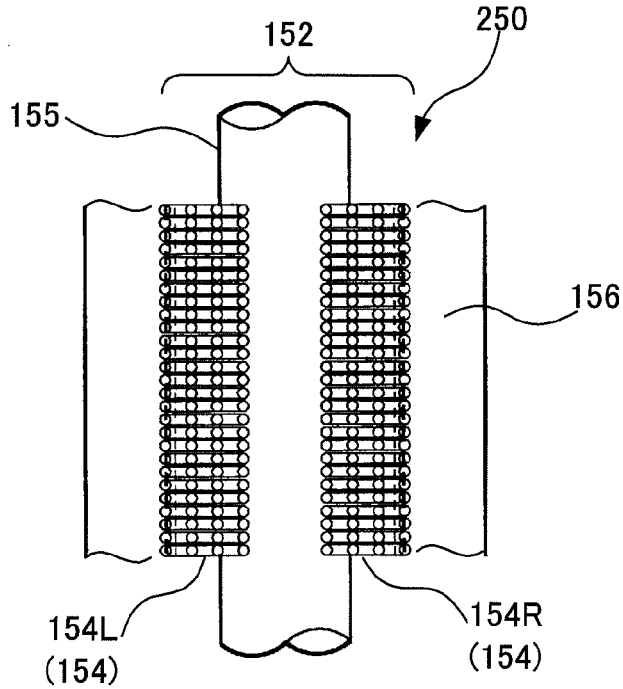
RELATED ART FIG.14B
FIG. 14B is a plain view of the comparative example corresponding to FIG. 13B.
Figure 14A:
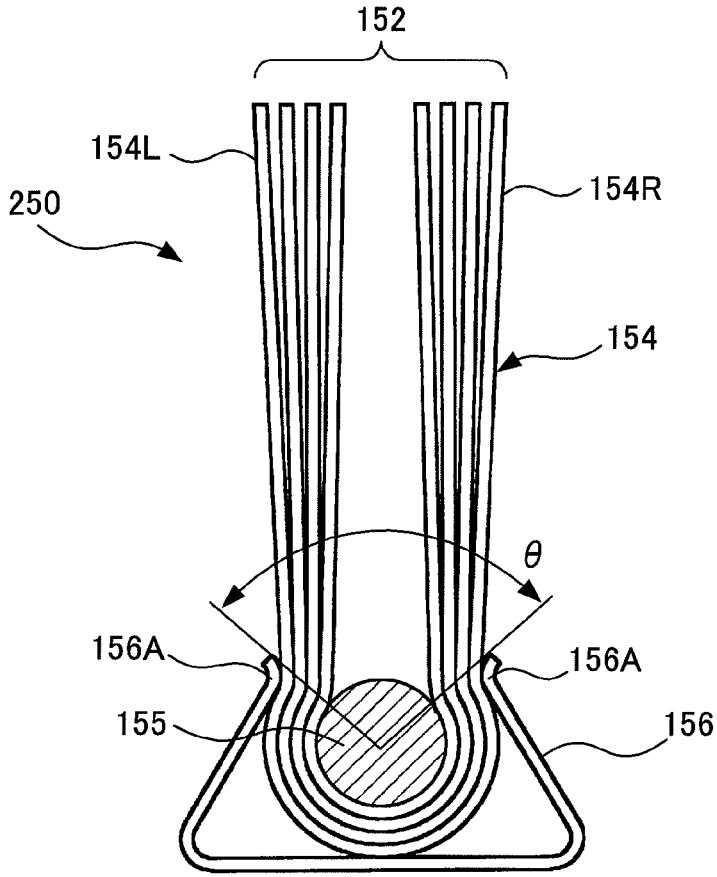
FIG. 14A is an enlarged sectional view of a comparative example corresponding to FIG. 13A.

FIG. 12 is an enlarged sectional view illustrating part of the polishing brush 150 in the axial direction. FIG. 13A is an enlarged sectional view of a XIII-XIII line in FIG. 4B (however, it is shown upside down,) and FIG. 13B is a plain view thereof. FIG. 14A is an enlarged sectional view of a comparative example corresponding to FIG. 13A, and FIG. 14B is a plain view of the comparative example corresponding to FIG. 13B.

The polishing brush 150 is, as shown in FIG. 4B, formed by winding and fixing a brush row 152 spirally around the shaft core 151 with a predetermined interval and then, by cutting the bristles of the brush row 152 to a predetermined length.

The brush row 152 is formed by, as shown in FIGS. 12, 13A and 13B, folding the brush bristle material 154 with a predetermined length into two at the center (bending the brush bristle material 154 so that one end side and the other end side of the bundle of the brush bristle material 154 are put together) while the brush bristle material 154 wraps a core metal 155 as a core material that restricts bending, and the bending portion of the brush bristle material 154 that winds around the core metal 155 is caulked from outside by a base fixture 156 as a brush base material. That is, the base fixture 156 wraps and integrates the core metal 155 and the brush bristle material 154 together. The core metal 155 is formed by a wire material made of stainless steel alloy or the like. By this arrangement, the brush bristle material 154 of the brush row 152 is integrally fixed to the core metal 155, and as shown in FIG. 12, formed in a row state with respect to the shaft core 151. Thus, bristle tip ends 154L and 154R extend radially from the core metal 155.

The base fixture 156 is made of SECC (electrogalvanized steel plate) or the like, and the cross section of the base fixture 156 forms like a U-shape. The brush bristle material 154 is sandwiched between both tip end edges 156A and the core metal 155, respectively (by pressing the brush bristle material 154 onto the core metal 155 by the tip end edges 156A) to fix the brush bristle material 154 to the core metal 155. The base fixture 156 is, as shown in FIG. 12, formed by winding the base fixture 156 around the shaft core 151 spirally in contact with each other in the axial direction so that the interval of the brush row 152 and the portion having the brush clearance 153 are constant. That is, the width of the base fixture 156 is set to a dimension larger than the minimum width required for a function to fix the brush bristle material 154 to the core metal 155 and regulating the interval of the brush row 152.

The brush bristle material 154 is made of nylon or the like, and is formed with a diameter of 0.1 mm, for example. With regard to the brush bristle material 154, a portion covered by the base fixture 156 is arranged along the periphery of the core metal 155, and a portion protruding from the tip end edge 156A of the base fixture 156 at the tip end side (tip ends 154L and 154R) rises in a free state.

Here, the gradient of the tip ends 154L and 154R located on both sides of the brush bristle material 154 is changed by the method of caulking of the base fixture 156. Specifically, the gradient such as a rising angle or the like of the tip ends 154L and 154R of the brush bristle material 154 is varied according to an open angle θ (theta) of the both tip end edges 156A of the base fixture 156 in the circumferential direction of the core metal 155.

In the polishing brush 150 in the present exemplary embodiment, as shown in FIGS. 13A and 13B, the open angle θ (theta) of the base fixture 156 is set so that the both tip ends 154L and 154R of the brush bristle material 154 are brought into contact with each other and are leaning each other at the tip ends. By this arrangement, the tip ends 154L and 154R of the large number of brush bristle materials 154 on both sides collects in the circumferential direction of the core metal 155. That is, the one end side (the tip ends 154L or 154R) and the other end side (the tip ends 154R or 154L) of the bundle of the brush bristle material 154 are matched and concentrated toward the center part of the core metal 155.

The polishing brush 150 in the above configuration has higher brush hardness than a polishing brush 250 in the comparative example shown in FIGS. 14A and 14B even if the same brush bristle material 154 is used.

This is considered to be because the tip ends 154L and 154R of the large number of brush bristle materials 154 gather and the large number of brush bristle materials 154 are deformed when one brush bristle material 154 receives a deforming force even if rigidity of each of the brush bristle materials 154 is the same.

The polishing brush 250 in the comparative example has the open angle θ (theta) of the base fixture 156 wider than that of the polishing brush 150 in the present exemplary embodiment, and the tip ends 154L and 154R of the brush bristle materials 154 are loose in the circumferential direction. In the polishing brush 250 with the tip ends 154L and 154R loosened in the circumferential direction as described above, each bristle of the brush bristle material 154 is deformed singularly and independently, therefore, a simple addition of the deformation rigidity results in the brush hardness. In other words, the brush hardness of the polishing brush 250 with this configuration is in the lowest state (hereinafter referred to as a base state) among those in the cases where the same number of the same brush bristle materials 154 is used. In the polishing brush 150 of the present exemplary embodiment, since the tip ends 154L and 154R located on both sides of the brush bristle material 154 are put together, the brush hardness becomes higher than the base state.

With regard to the polishing brush 250 in the comparative example with the brush hardness in the base state, the brush hardness may be increased by improving the rigidity of the individual brush bristle materials 154. That is, it is only necessary to use a material with high rigidity as the brush bristle material 154 or to increase the wire diameter for the brush bristle material 154. However, if the rigidity of the individual brush bristle materials 154 is improved, contact pressure of the individual tip ends 154L and 154R on the polished surface becomes large. As a result, the polishing amount may become uneven depending on a location in the polished surface.

With regard to the polishing brush 150 in the exemplary embodiment, since the entire brush hardness is improved without increasing the rigidity of the individual brush bristle materials 154, it is able to carry out the polishing work efficiently by inhibiting unevenness of the polishing amount.

Next, an inspection for determining whether or not the above polishing brush 150 has predetermined brush hardness will be described.

In the above inner circumference polishing work for the disk-shaped substrates 10, a difference is generated in time required for polishing the same amount depending on the brush hardness of the polishing brush 150, which affects the polishing work efficiency. That is, if the brush hardness of the polishing brush 150 is low, much time is required for polishing and the polishing work efficiency is lowered.

By using the polishing brush 150 with the appropriate brush hardness and brush bristle materials collecting at the center thereof, the polishing work time may be reduced and made constant, which leads to rational polishing work.

For that purpose, it is necessary to inspect the polishing brush 150 to determine whether or not the polishing brush 150 has predetermined brush hardness, and to use only the polishing brush 150 with the predetermined brush hardness. In the exemplary embodiment, the brush hardness is easily determinable by morphological features.

That is, in observation of the appearance of the polishing brush 150, it is checked whether or not the tip ends 154L and 154R located on both sides of the brush bristle materials 154 configuring the brush row 152 are gathered at the center of the brush row 152.

By this inspection, it is confirmed that the polishing brush 150 has the brush hardness of the base state or above. At that time, whether or not the core metal 155 is seen at the center of the brush row 152 may be used as a determination criterion (an inspection criterion). That is, it is checked whether or not the one end side (the tip ends 154L or 154R) and the other end side (the tip ends 154R or 154L) of the bundle are gathered to an extent where the core metal 155 is hidden by the brush bristle material 154 and is not seen.

When the core metal 155 is not seen at the center of the brush row 152, the tip ends 154L and 154R located on both sides of the brush bristle materials 154 gather at the center of the brush row 152. Such a polishing brush 150 is determined as having the predetermined brush hardness or above.

On the contrary, if the core metal 155 is seen at the center of the brush row 152, the tip ends 154L and 154R located on both sides of the brush bristle materials 154 do not lean each other at the center of the brush row 152 and do not gather. Such a polishing brush 150 is determined as having the base-state brush hardness but not having the predetermined brush hardness.

The brush hardness may be determined by using an enlarging device such as a microscope with an appropriate magnifying power (100 magnifications, for example.)

Figure 15A:
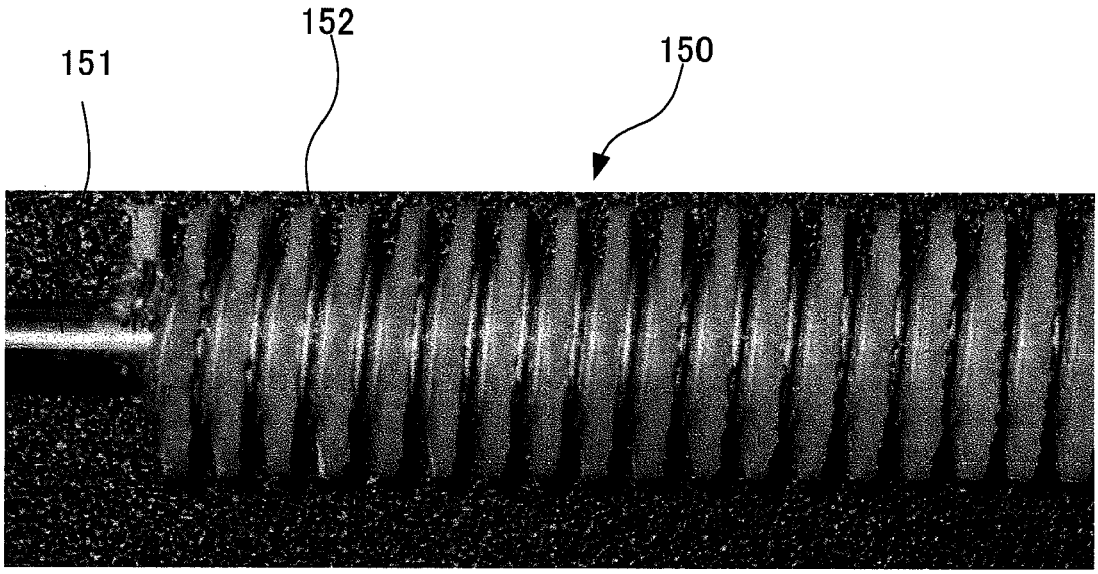
FIG. 15A shows an appearance of the polishing brush with high brush hardness
Figure 15B:
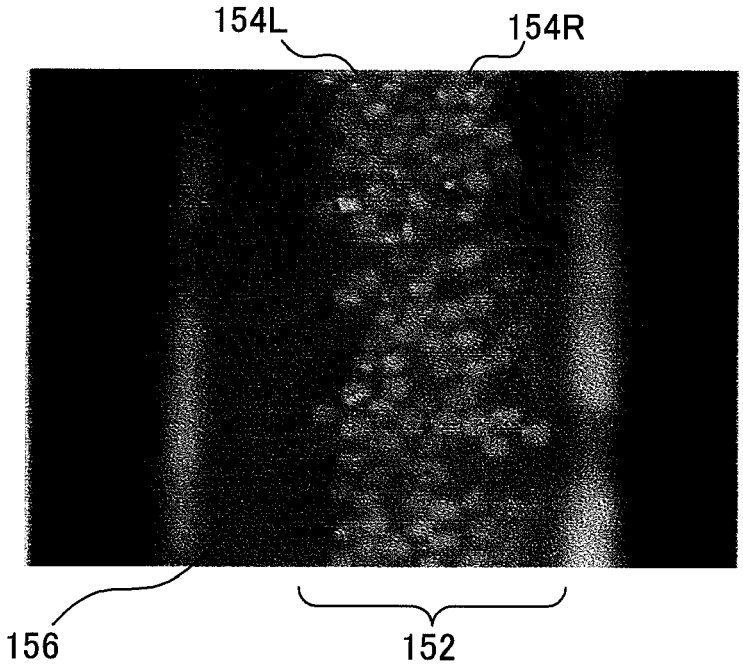
FIG. 15B is an enlarged photo of the brush row with high brush hardness.
Figure 16A:
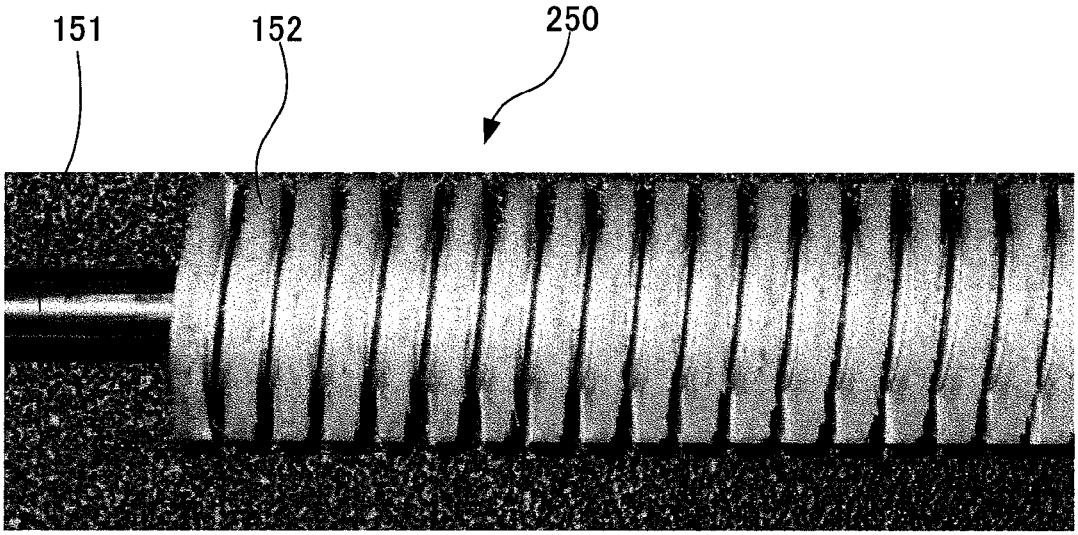
RELATED ART FIG.16A
FIG. 16A shows an appearance of the polishing brush with low brush hardness.
Figure 16B:
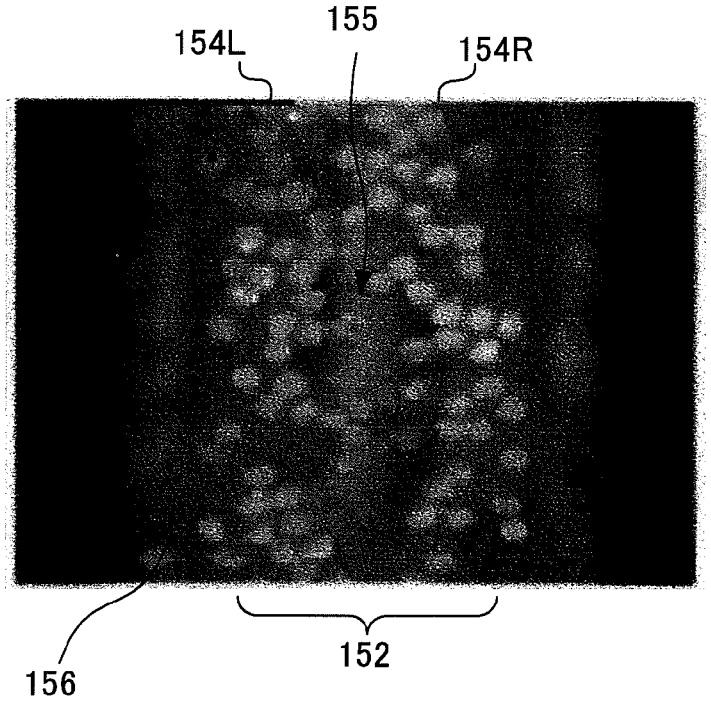
FIG. 16B is an enlarged photo of the brush row with low brush hardness.

FIGS. 15A to 16B show photos of specific examples. FIG. 15A shows an appearance of the polishing brush 150 with high brush hardness and FIG. 15B is an enlarged photo of the brush row 152. FIG. 16A shows an appearance of the polishing brush 250 with low brush hardness and FIG. 16B is an enlarged photo of the brush row 152. Note that the same reference numerals of portions are given in FIGS. 13A, 13B, 14A and 14B.

In the polishing brush 150 with high brush hardness shown in FIG. 15A, as described in the above determination criterion, the tip ends 154L and 154R located on both sides of the brush bristle materials 154 gather at the center of the brush row 152 in a high density, and the core metal 155 is not seen as shown in FIG. 15B. On the other hand, in the polishing brush 250 with low brush hardness shown in FIG. 16A, there is a portion having a clearance where the tip ends 154L and 154R located on both sides of the brush bristle materials 154 do not reach at the center of the brush row 152 as shown in FIG. 16B, and the core metal 155 may be seen from the portion having the clearance.

With these polishing brushes 150 and 250, the above-mentioned polishing work of the inner circumferential surface of the disk-shaped substrates 10 was carried out under the same conditions and time required for polishing for 13 to 20 μm (micrometer) was measured. As a result, the average time was 16 minutes for the polishing brush 150 in the exemplary embodiment, and it was 32 minutes for the polishing brush 250 in the comparative example. The polished surface was favorable with the polishing brush 150 in the exemplary embodiment, but streaks were found on the polished surface with the polishing brush 250 in the comparative example. As mentioned above, with the polishing brush 150 in the exemplary embodiment, the polishing work may be completed in approximately half the polishing time of the polishing brush 250 in the comparative example. The polished surface is favorable, and effectiveness of the configuration is verified. The reason why the streaks are found on the polished surface with the polishing brush 250 with low brush hardness in the comparative example is that the thin and flexible tip ends of the brush bristle material 154 intrude into a micro crack formed when the inner circumferential surface of the portion having the opening hole 12 of the disk-shaped substrates 10 was ground with an inner circumference grind sotne 22 (see FIG. 1B) in the previous process and the crack is considered to be widened by the polishing action.

Specifications of the polishing brushes 150 and 250 shown in FIGS. 15A to 16B are as follows:

Outer diameter of the brush: Φ 13 mm

Diameter of the shaft core 151: Φ 4 mm

Material of the brush bristle material 154: 66-nylon

Diameter of the brush bristle material 154: Φ 0.1 mm

Density of the brush bristle material 154 in the brush row 152: 400 to 500 pieces/cm Diameter of the core metal 155: Φ 0.6 mm As mentioned above in detail, according to the polishing brush 150 of the exemplary embodiment, the polishing brush 150 with appropriate brush hardness and brush bristle materials collecting at the center thereof is obtainable. Also, the polishing brush 150 with such brush hardness is easily determinable from the appearance. Moreover, by using the polishing brush 150 as described above, the stable and highly accurate polishing work may be carried out efficiently.

The invention of the present embodiment is not limited to the configuration of the above exemplary embodiment but capable of changes as appropriate.

While the preferred embodiments of the present invention have been illustrated and described, it will be understood by those skilled in the art that various changes and modifications may be made, and equivalents may be substituted for elements thereof without departing from the true scope of the present invention. In addition, many modifications may be made to adapt to a particular situation and the teaching of the present invention without departing from the central scope. Therefore, it is intended that the present invention not be limited to the particular embodiment disclosed as the best mode contemplated for carrying out the present invention, but that the present invention includes all embodiments falling within the scope of the appended claims.

What is claimed is:

1. A polishing apparatus that polishes an inner circumferential surface of a disk-shaped substrate including a portion having a hole at the center thereof, the polishing apparatus comprising:

a holding unit that holds piled workpieces in which a plurality of the disk-shaped substrates are piled;

a polishing brush that is inserted into the portion having the hole of the disk-shaped substrates of the piled workpieces and is rotated;

a cover member that covers the piled workpieces; and a polishing-liquid flowing-in unit that flows polishing liquid into the portion having the hole of the disk-shaped substrates of the piled workpieces covered by the cover member, and wherein the polishing flow-in unit flows fresh polishing liquid into a clearance between an inner circumference of the cover and an outer circumference of the piled disk-shaped substrates and the polishing liquid is supplied from an outer circumferential surface of the piled workpieces to the center portion having the hole.

2. The polishing apparatus according to claim 1, wherein the polishing brush comprises a shaft core, a brush base wound around the shaft core, and a brush bristle bent and attached in a bundle to the brush base, and the brush bristle is attached to the brush base by being bent so that one end side and the other end side of the bundle are put together.

3. The polishing apparatus according to claim 1, wherein the piled workpieces has a guide spacer between the piled disk-shaped substrates, the guide spacer has a portion having a hole at the center thereof and a penetration portion that penetrates a portion between the portion having the hole and the outside thereof, and the polishing-liquid flowing-in unit flows the polishing liquid into the portion having the hole of the disk-shaped substrate via the penetration portion of the guide spacer.

4. The polishing apparatus according to claim 3, wherein the cover member is formed so that the polishing liquid is led to the guide spacers along an outer circumferential surface of the piled workpieces.

5. The polishing apparatus according to claim 1, wherein the cover member covers the piled workpieces with a portion having a predetermined clearance between the outer circumferential surface of the piled workpieces and the cover member.

6. The polishing apparatus according to claim 5, wherein the cover member is cylindrically formed and has a portion having a drain hole for the polishing liquid in the vicinity of one end of the cover member.

7. A polishing brush that is used for polishing of a disk-shaped substrate including a portion having a hole at the center thereof, the polishing brush comprising:

a shaft core;

a brush base wound around the shaft core; and a brush bristle bent and attached to the brush base as a bundle, wherein the brush bristle is attached to the brush base by being bent so that one end side and the other end side of the bundle are put together, and wherein an angle θ is set so that both tip ends of the brush bristle are brought into contact with each other and are leaning against each other at the tip ends.

8. The polishing brush according to claim 7, wherein the brush base to which the brush bristle is attached is wound spirally around the shaft core, and the one end side and the other end side of the brush bristle extend radially from the shaft core.

9. The polishing brush according to claim 7, wherein the polishing brush further comprises a core material that restricts bending of the brush bristle inside the bending of the brush bristle, and the brush base attaches the brush bristle while wrapping the core material and the brush bristle.

10. The polishing brush according to claim 7, wherein the brush bristle as the bundle are bent in such a state that the one end side and the other end side of the brush bristle are concentrated toward the center part of the core material from the position restricted by the core material.

11. A manufacturing method of a disk-shaped substrate by polishing an inner circumferential surface of the disk-shaped substrate including a portion having a hole at the center, the manufacturing method of the disk-shaped substrate comprising:

a holding process that holds piled workpieces in which a plurality of the disk-shaped substrates to be polished are piled;

a covering process that covers an outer circumferential surface of the piled workpieces held by a cover member in the holding process; and a polishing process that polishes the inner circumferential surface of the disk-shaped substrate by inserting a polishing brush into the portion having the hole of the disk-shaped substrates in the piled workpieces covered by the cover member and held in the holding process, rotating the polishing brush and flowing polishing liquid into the portion having the hole, and wherein a polishing flow-in unit flows fresh polishing liquid into a clearance between an inner circumference of the cover and an outer circumference of the piled disk-shaped substrates and the polishing liquid is supplied from an outer circumferential surface of the piled workpieces to the center portion having the hole.

12. The manufacturing method of the disk-shaped substrate according to claim 11, wherein the polishing brush used in the polishing process comprises:

a shaft core;

a brush base wound around the shaft core; and a brush bristle bent and attached to the brush base as a bundle, and the brush bristle is attached to the brush base by being bent so that one end side and the other end side of the bundle are put together.

13. The manufacturing method of the disk-shaped substrate according to claim 11, wherein the holding process sandwiches a guide spacer including a portion having a hole at the center thereof and a penetration portion that penetrates a portion between the portion having the hole and the outside thereof between the piled disk-shaped substrates, and the polishing process flows the polishing liquid into the portion having the hole of the disk-shaped substrate via the penetration portion of the guide spacer using the cover member.

14. The manufacturing method of the disk-shaped substrate according to claim 11, wherein the disk-shaped substrates are attached to a substrate holder piling and holding the disk-shaped substrates in the holding process.

* * * * *